US009933141B2

(12) United States Patent
Cronk et al.

(10) Patent No.: US 9,933,141 B2
(45) Date of Patent: Apr. 3, 2018

(54) LUMINAIRE AND LUMINAIRE COMPONENTS

(71) Applicant: HYGRO INTERNATIONAL PTY LIMITED, Brookvale (AU)

(72) Inventors: Paul Andrew Cronk, Brookvale (AU); Christopher Reynolds, Vancouver, WA (US)

(73) Assignee: Hygro International Pty Limited (AU)

( * ) Notice: Subject to any disclaimer, the term of this patent is extended or adjusted under 35 U.S.C. 154(b) by 337 days.

(21) Appl. No.: 14/843,381

(22) Filed: Sep. 2, 2015

(65) Prior Publication Data

US 2016/0069543 A1 Mar. 10, 2016

Related U.S. Application Data

(63) Continuation-in-part of application No. 29/481,879, filed on Feb. 11, 2014, now Pat. No. Des. 758,646.
(Continued)

(30) Foreign Application Priority Data

Mar. 19, 2015 (AU) ..... 2015900992

(51) Int. Cl.
*F21V 19/02* (2006.01)
*F21V 19/00* (2006.01)
(Continued)

(52) U.S. Cl.
CPC ..... *F21V 19/009* (2013.01); *F21V 7/005* (2013.01); *F21V 19/008* (2013.01); *F21V 19/02* (2013.01); *F21V 7/16* (2013.01); *F21Y 2103/00* (2013.01)

(58) Field of Classification Search
CPC ..... F21V 19/009; F21V 19/008; F21V 19/02; F21V 7/005
See application file for complete search history.

(56) References Cited

U.S. PATENT DOCUMENTS 3,792,247 A * 2/1974 Beuttell ..... F21S 8/031 362/225
5,134,553 A 7/1992 Hasegawa
(Continued)

FOREIGN PATENT DOCUMENTS

AU 2010200796 A1 3/2010
WO 9637732 A1 11/1996
(Continued)

OTHER PUBLICATIONS

Australian Patent Office, International Preliminary Report on Patentability of the International Preliminary Examining Authority, dated May 9, 2016, for PCT/AU2015/050491.

*Primary Examiner* — Anh Mai
*Assistant Examiner* — Nathaniel Lee
(74) *Attorney, Agent, or Firm* — Design IP

(57) ABSTRACT

A luminaire (41, 141) for a double ended tubular HID lamp (110) is disclosed. The luminaire has a V-shaped reflector (2) having a spine (3) and is bendable into a tensioned state having a generally M-shaped configuration. A pair of lamp holders (60, 61; 160, 161) is connected to the spine and spaced apart a distance corresponding to the length of the tubular lamp. A hollow conduit (43, 158) extends between the lamp holders. A pair of insulated cables (31, 32) interconnects the lamp holders with one of the cables (32) passing through the hollow conduit. The distance between the spine (3) and lamp (110) is able to be adjusted.

17 Claims, 24 Drawing Sheets

Related U.S. Application Data

(60) Provisional application No. 62/045,815, filed on Sep. 4, 2014.

(51) Int. Cl.

| | |
|---|---|
| ***F21V 7/00*** | (2006.01) |
| *F21V 7/18* | (2006.01) |
| *F21V 7/16* | (2006.01) |
| *F21Y 103/00* | (2016.01) |

(56) References Cited

U.S. PATENT DOCUMENTS

| | | | | |
|---|---|---|---|---|
| 5,461,554 | A * | 10/1995 | Leonetti | F21V 15/04 248/604 |
| 6,053,624 | A * | 4/2000 | Cronk | F21V 7/10 362/297 |
| 6,676,277 | B1 * | 1/2004 | Gordin | F21V 23/06 313/51 |
| 6,783,263 | B1 | 8/2004 | Cronk | |
| 7,156,539 | B2 | 1/2007 | Cronk | |
| D544,136 | S | 6/2007 | Hargreaves | |
| D544,138 | S | 6/2007 | Hargreaves | |
| D544,994 | S | 6/2007 | Hargreaves | |
| D545,485 | S | 6/2007 | Hargreaves | |
| D758,646 | S | 6/2016 | Reynolds | |
| 2008/0094849 | A1 * | 4/2008 | Lu | F21V 19/009 362/396 |
| 2013/0155685 | A1 | 6/2013 | Stanley | |

FOREIGN PATENT DOCUMENTS

| | | | |
|---|---|---|---|
| WO | 2003072998 | A1 | 9/2003 |
| WO | 2013114141 | A1 | 8/2013 |

* cited by examiner

LUMINAIRE AND LUMINAIRE COMPONENTS

FIELD OF THE INVENTION

The present invention relates to luminaires, and, in particular, to luminaires which are used in horticultural activities.

BACKGROUND OF THE INVENTION

A luminaire particularly suitable for horticultural activities is known from WO 1996/037732 and is illustrated in FIG. 1. The luminaire 1 has a reflector 2 fabricated from sheet metal with a generally V-shaped spine 3. The reflector has two wings 4, 5. In their un-stressed state (not illustrated) the wings 4, 5 lie in a V-shape but in operation are stressed by bending into a generally M-shaped configuration as illustrated in FIG. 1. The M-shaped configuration is maintained by means of two chains, wires, or other filaments 7 (only one of which is illustrated in FIG. 1). By adjusting the length of the filament 7, so the degree of curvature of the reflector wings 4, 5 can be changed and thus the focal length of the luminaire 1 can be adjusted.

Located below the spine 3 is a lamp holder and socket 9 which accepts a lamp 10 having a threaded screw-in fitting at one end thereof. Thus the lamp 10 is suspended in cantilever fashion below the spine 3. Because of the cantilever support of the lamp 10, the free end of the lamp tends to droop somewhat. As a consequence, the longitudinal axis of the lamp 10 is not always parallel to the longitudinal axis of the spine 3, the parallel situation being the desired operating condition. The operating temperature of the lamp 10 is approximately 400° C. and the centreline of the lamp 10 is spaced from the spine by a distance of approximately 55 mm.

This arrangement has worked well for many years, however, developments in high intensity discharge (HID) lamp technology mean that a new type of lamp has recently been developed. The new type of lamp enables higher wattages and better electrical efficiency to be achieved. The new type of lamp has two electrodes 11, 12 but located one at each end and is known as a double ended lamp or DE lamp.

GENESIS OF THE INVENTION

The genesis of the present invention is a desire to provide a luminaire or luminaires suitable for the DE lamp 110.

SUMMARY OF THE INVENTION

In accordance with a first aspect of the present invention there is disclosed a luminaire for a double ended tubular HID lamp, said luminaire comprising:

a reflector of generally rectangular configuration when viewed in plan, formed from sheet metal, having a V-shaped configuration when viewed in end elevation and in a relaxed state, and being bendable into a tensioned state having a generally M-shaped configuration when viewed in end elevation, a central region of said V and M shape constituting a spine;

a pair of lamp holders connected to said spine and spaced apart a distance corresponding to the length of said tubular lamp; and a hollow conduit extending between said lamp holders;

wherein said hollow conduit has a pair of arms corresponding to each said lamp holder and arranged to receive said lamp holder, and at least one fastener passes through each said arm and into said lamp holder whereby said fasteners determine the spacing of said lamp holders relative to said spine In accordance with a second aspect of the present invention there is disclosed a luminaire for a double ended tubular HID lamp, said luminaire comprising:

a reflector of generally rectangular configuration when viewed in plan, formed from sheet metal, having a V-shaped configuration when viewed in end elevation and in a relaxed state, and being bendable into a tensioned state having a generally M-shaped configuration when viewed in end elevation, a central region of said V and M shape constituting a spine;

a pair of lamp holders connected to said spine and spaced apart a distance corresponding to the length of said tubular lamp;

a hollow conduit extending between said lamp holders; and a pair of insulated electric cables extending away from a first one of said lamp holders, a first one of said cables being connected to said first lamp holder and a second one of said cables extending through said hollow conduit to said second lamp holder.

In accordance with a third aspect of the present invention there is disclosed a ridge cap for a luminaire having a reflector of generally rectangular configuration when viewed in plan, formed from sheet metal, having a V-shaped configuration when viewed in end elevation and in a relaxed state, and being bendable into a tensioned state having a generally M-shaped configuration when viewed in end elevation, a central region of said V and M shape constituting a spine, said ridge cap comprising a pair of flats having an angle approximating to that of said spine, a pair of spaced apart lamp holders mounted to said ridge cap and spaced apart by a distance determined by the lamp length, and a power supply wire extending between said lamp holders and being located within an interior of said ridge cap.

In accordance with a fourth aspect of the present invention there is disclosed a method of forming a hollow cable conduit for a luminaire, said method comprising the steps of forming an inner V-shaped ridge cap having a gutter, forming an outer V-shaped ridge cap having a slot, and nesting said inner and outer ridge caps so as to pass said gutter through said slot.

In accordance with another aspect of the present invention there is disclosed a luminaire for a double ended lamp having an electrical contact at each end thereof, said luminaire comprising a reflector having a centre-line, a cable conduit extending along said centre-line between a pair of lamp holders and including an electrical cable therein, and each of said lamp holders being independently manipulatable to enable a lamp to be mounted between said holders and substantially parallel to said centre-line.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENTS

Figure 3:
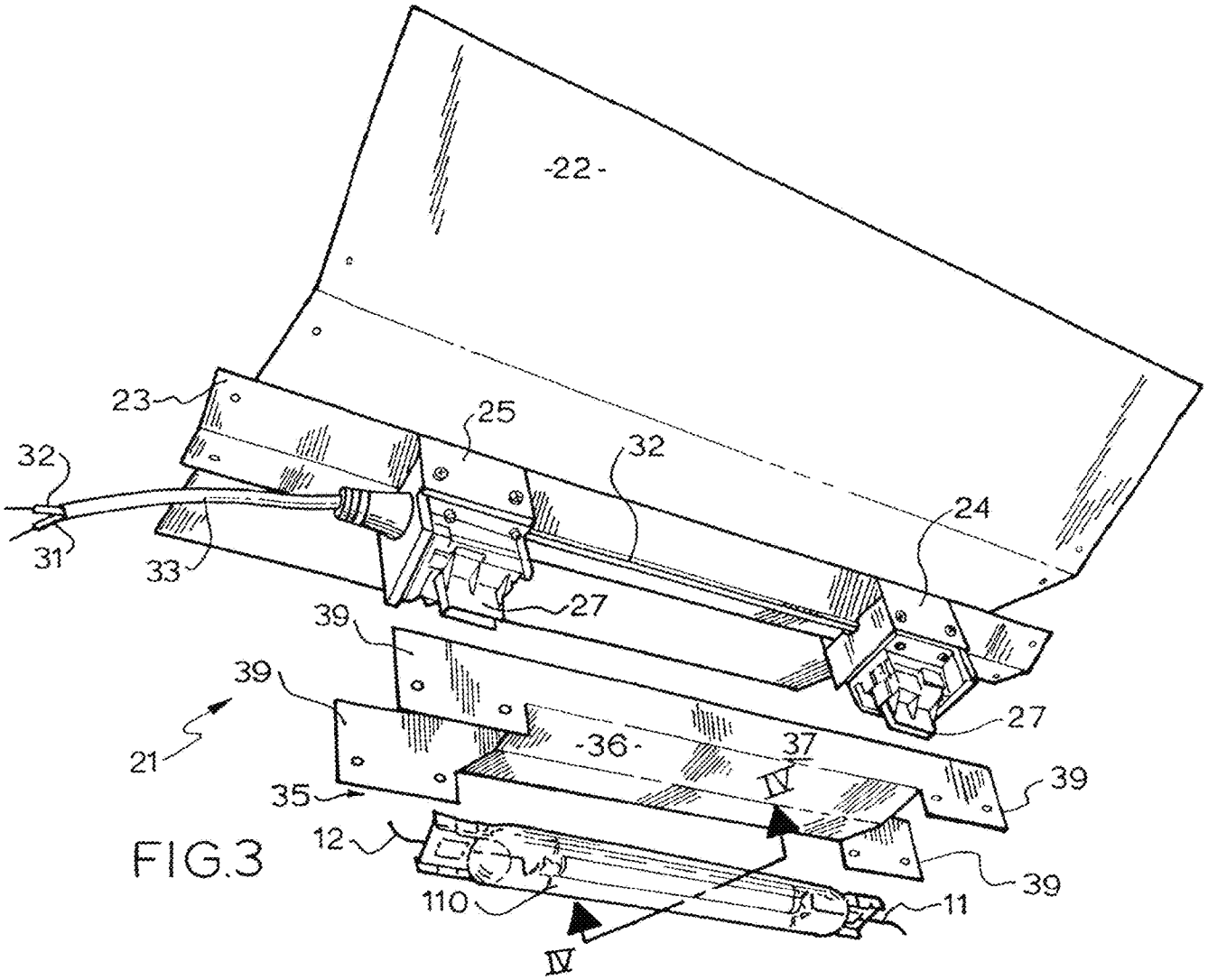
FIG. 3 is an exploded perspective view of a first arrangement of a luminaire to accommodate a DE lamp.

Turning now to FIG. 3, the luminaire 21 as illustrated in FIG. 3 has a reflector 22 which is formed from a single sheet of metal which has been rolled to provide the V-shaped profile illustrated. A V-shaped carrier 23 is provided which has a length the same as the length of the reflector 22. Mounted on the V-shaped carrier 23 are two moulded plastic electrode clamps 24, 25 each of which has an upstanding projection 27 which is able to slide along the longitudinal axis of the V-shaped carrier 23 between an electrode receiving position (not illustrated) and an electrode clamping position as illustrated in FIG. 3. A pair of insulated electric cables 31, 32 within a common sheath 33, extends away from the electrode clamp 25. One of the cables 31 is connected to the electrode clamp 25. The other cable 32 extends underneath the electrode clamp 25 and is connected to the electrode clamp 24.

In order to mount the DE lamp 110, firstly the projections 27 are drawn back and the lamp 110 is inserted between the clamps 24 and 25. Secondly, the projections 27 are then slid towards the lamp 110 into the position illustrated in FIG. 3. The result is that the lamp 110 is clamped between the two electrode clamps 24, 25 and the electrodes 11, 12 are connected to the insulated electric cables 32, 31 respectively.

Figure 1:
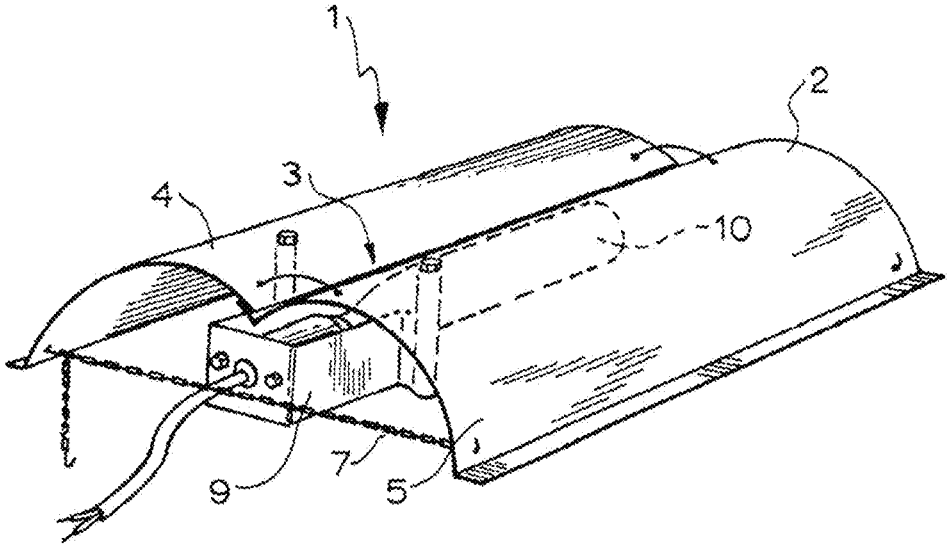
FIG.1 PRIOR ART
FIG. 1 is a perspective view of a prior art luminaire.
Figure 2:
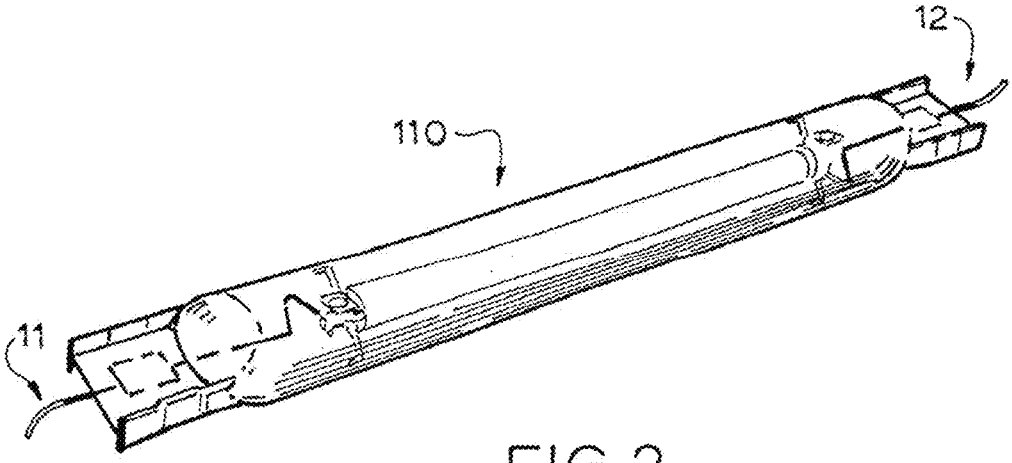
FIG.2 PRIOR ART
FIG. 2 is a perspective view of a prior art DE lamp.

Although not illustrated in FIG. 3, it will be apparent to those skilled in the art that the reflector 22 is stressed or tensioned prior to the operation of the lamp 110 so as to be moved from the V-shaped configuration illustrated in FIG. 3 into the generally M-shaped configuration illustrated in FIG. 1.

In order to comply with electrical wiring rules requiring that the cable 32 be covered, a generally V-shaped cable cover 35 is provided. The cable cover 35 has a V-shaped roof 36 with an included angle of about 160°, two side walls 37, 38 only one of which is visible in FIG. 3, and four vertical end pieces 39. In the absence of the lamp 110, the cable cover 35 is positioned over the wire 32 and the end pieces 39 are secured to the electrode clamps 24, 25. Thus the roof 36 together with the V-shaped carrier 23 forms a hollow conduit through which the cable 32 passes between the electrode clamps 24, 25. It will be appreciated in this connection that the roof 36 forms part of the reflective surface of the overall reflector 22. Thus the cable cover 35 is preferably made from reflective sheet metal. Preferably this reflective sheet metal is dimpled so as to provide a diffusing action in reflecting the light from the lamp 110.

The arrangement illustrated in FIG. 3, whilst functional and having many advantages, has a number of difficulties. In particular, the electrode clamps 24, 25 have a substantial vertical extent, and thus the roof 36 ends up being spaced some considerable distance (eg 100 mm or 4 inches) from the remainder of the reflective surfaces of the reflector 22. This changes the optical performance of the luminaire 21 relative to that of the luminaire 1.

Figure 4:
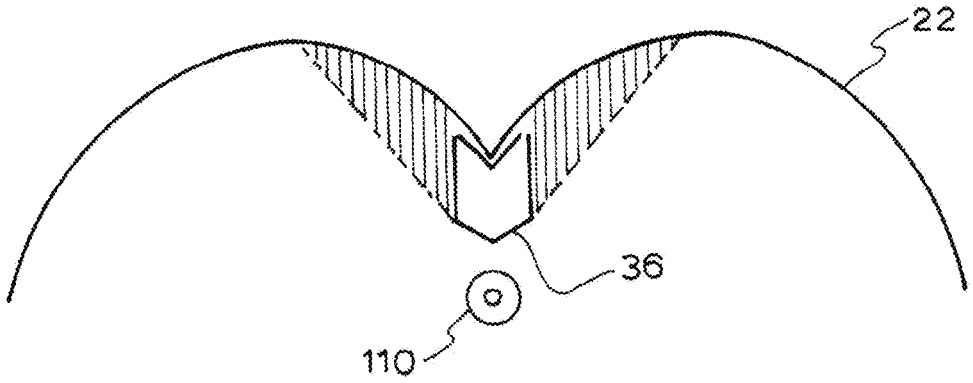
FIG. 4 is a cross-sectional view along the line IV-IV of FIG. 3 showing the shading of some portions of the reflector.

In particular, as seen in FIG. 4, the distance of the roof 36 from the reflector 22 means that the lamp 110 is also positioned away from the reflector 22 relative to the prior art arrangement of FIG. 1. Also, because of the relatively flat pitch of the roof 36 and the width of the roof 36, a portion of the reflector 22 is shaded, as indicated in FIG. 4 by vertical lines. That is, the shaded portion of the reflector 22 does not receive direct light from the lamp 110. As a result, the intensity and illumination pattern of the arrangement illustrated in FIGS. 3 and 4 are not as desired.

Turning now to FIGS. 3 to 8, the luminaire 41 of a second arrangement will now be described. The luminaire 41 has the same reflector 2 with its spine 3 and wings 4, 5 as the prior art luminaire 1 of FIG. 1. Positioned over the spine 3 is a two part cable conduit 43 which consists of an inner shorter V-shaped ridge cap 44 having a bulbous gutter 45 which extends along the length of the inner ridge cap 44. An outer longer V-shaped ridge cap 47 extends the length of the reflector 2 and is provided with a centrally located elongate slot 48. The length of the slot 48 is substantially the same as the length of the inner ridge cap 44. This permits the inner ridge cap 44 to be nested into the outer ridge cap 47 with the bulbous gutter 45 protruding through the slot 48.

A pair of insulated electric cables 31, 32 within a common sheath 33, extends away from an electrode clamp 60. One of the cables 31 is connected to the electrode clamp 60. The other cable 32 extends underneath the electrode clamp 60 and is connected to a second electrode clamp 61. The electrode clamps or lamp holders 60, 61 will be described in more detail hereafter.

As a consequence of this arrangement, the bulbous gutter 45 provides a shielded conduit of small cross-sectional area through which the cable 32 can pass. Furthermore, the outer surface of the cable conduit 43 (including the bulbous gutter 45) is positioned very closely to the reflector 2. The cable conduit 43 is preferably made from the same reflective sheet metal material as the reflector 2. Thus the optical performance of the luminaire 41 is similar to that of the luminaire 1.

There is a close proximity between the lamp 110 and the reflector 2, which is preferably in the vicinity of 50 mm. Since the lamp 110 is hot in operation, the bulbous gutter 45 functions as a heat sink absorbing heat from the lamp and distributing it via the ridge caps 44, 47 to the reflector 2. Thus the reflector 2 functions as a heat radiating device in addition to being a reflector. As a consequence, notwithstanding that the temperature of the lamp 110 is approximately 500-600° C., the temperature of the cable 32 extending along the bulbous gutter 45 only reaches in the vicinity of 75° C. to 100° C. Consequently, at least this portion of the cable 32 is preferably provided with low cost insulation of a high temperature rating as is known from electric oven technology.

Mounted on the outer ridge cap 47 are two M-shaped brackets 51, 52 each of which has a pair of arms 53, 54. Each arm 53, 54 has a pair of slots 55. Each bracket 51, 52 supports a generally cubic electrode clamp 60, 61. The electrode clamps 60, 61 are retained in the bracket 51, 52 by means of finger tightenable screws 64 which have short threaded shafts which engage with threaded blind holes in the electrode clamps 60, 61. In this way, the position of the electrode clamps 60, 61 relative to the brackets 51, 52, and hence the reflector 2, can be adjusted within a narrow range of adjustments (typically the distance between the spine 3 and the longitudinal axis of the lamp 110 can be adjusted from a minimum of approximately 35 mm to a maximum of approximately 65 mm). Because there are two electrode clamps 60, 61, the lamp 110 does not tend to droop and the screws 64 can be set so as to ensure that the longitudinal axis of the lamp 110 is substantially parallel to the spine 3 of the reflector 2.

The electrode clamps 60, 61 are fabricated from plastic material and are intended by their manufacturer to be mounted on a flat surface. This is because most luminaires provide a flat, or substantially flat, surface adjacent the lamp 110. This flat surface is substantially parallel to the longitudinal axis of the lamp 110. However, the presence of the spine 3 which has an angle of approximately 120° means that the electrode clamps 60, 61 cannot be utilised as intended by their manufacturer.

For the prior art arrangement of FIG. 1, the lamp holder and socket 9 was fabricated from ceramic material and was intended to be mounted on a mounting surface which was perpendicular to the flat, or substantially flat, surface of most luminaires adjacent the lamp. One mounting arrangement which enables the lamp holder and socket 9 to be mounted on a luminaire without a flat surface and with a spine 3 is disclosed in European Patent No 2,325,554 the contents of which are hereby incorporated into the present specification for all purposes. Their mounting arrangement requires a multiplicity of metal components which need to be fabricated, and assembled, by the luminaire manufacturer in order to satisfactorily mount the lamp holder and socket 9.

Figure 5:
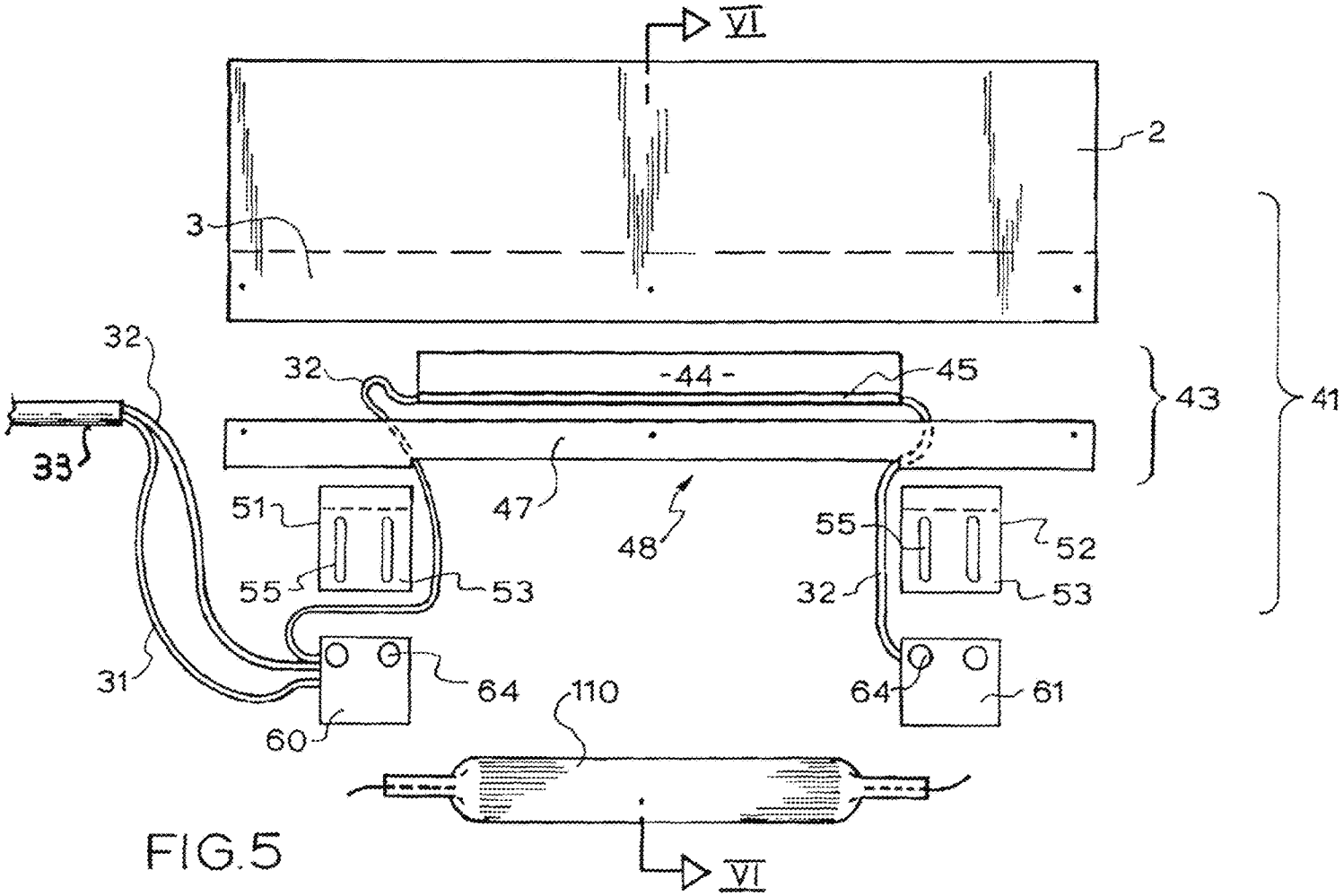
FIG. 5 is an exploded side elevation of a preferred embodiment of the present invention.
Figure 6:
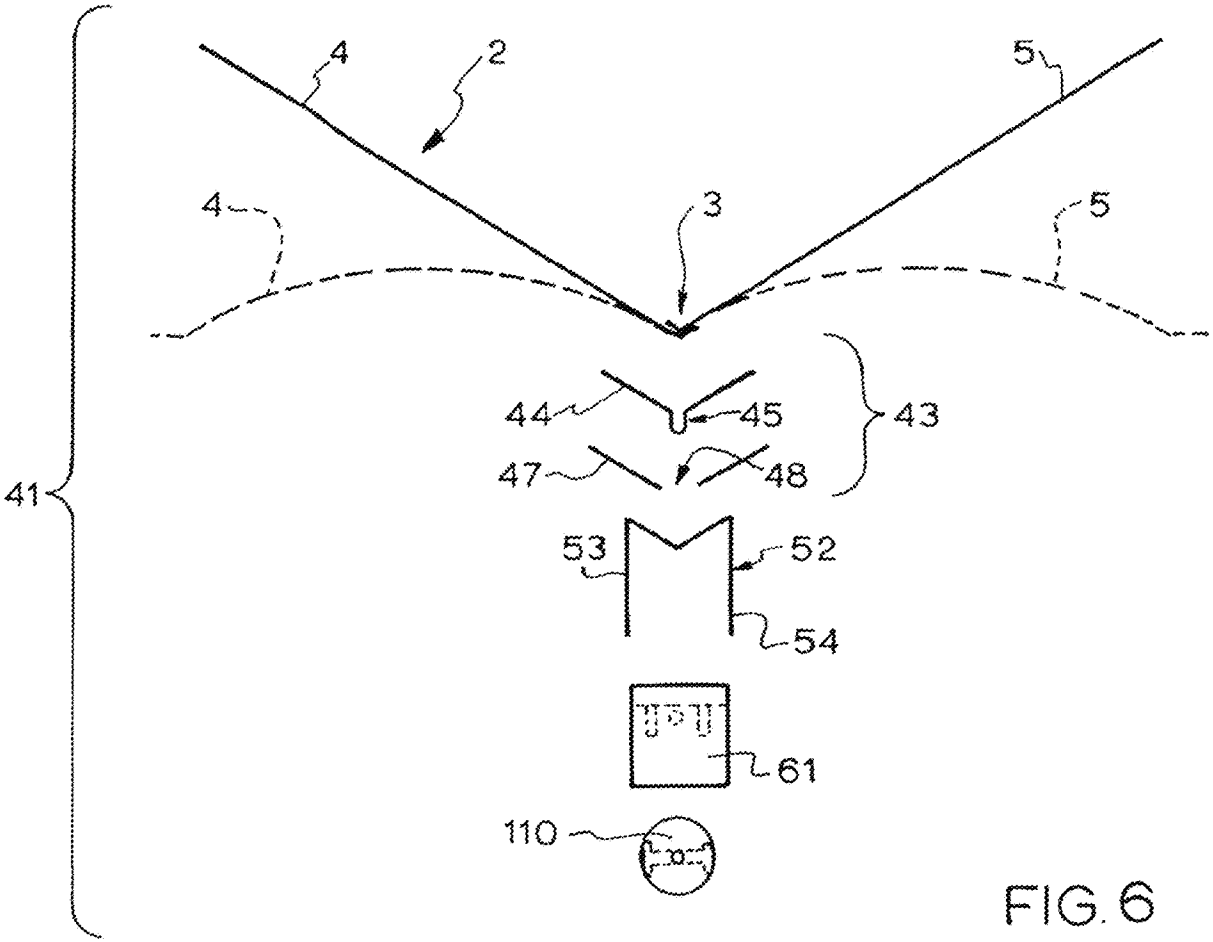
FIG. 6 is a cross-sectional view taken long the line VI-VI of FIG. 5.
Figure 7:
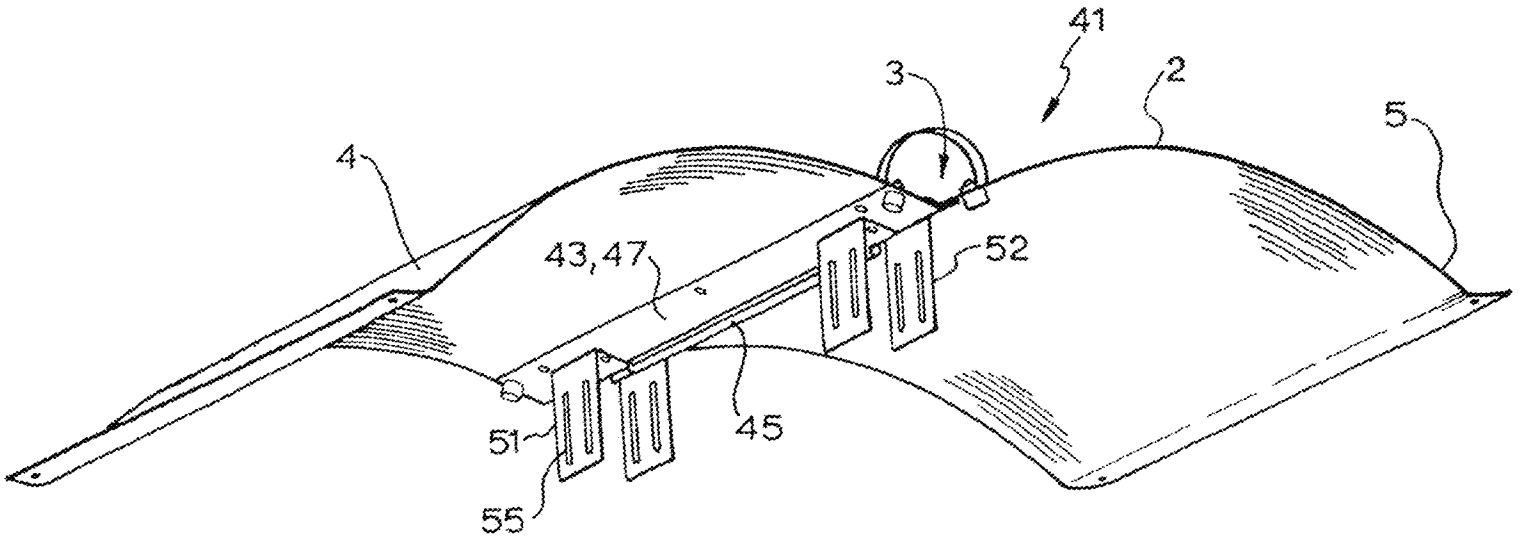
FIG. 7 is a perspective view from below of the reflector wings, the ridge caps and the brackets of FIGS. 5 and 6, the reflector being tensioned but the tensioning arrangement being omitted.

Although not illustrated in FIG. 5, it will be apparent to those skilled in the art that the reflector 2 is stressed or tensioned prior to the operation of the lamp 110 so as to be moved from the V-shaped configuration illustrated in solid lines in FIGS. 5 and 6 into the generally M-shaped configuration illustrated by broken lines in FIG. 6. The preferred tensioning arrangements are those disclosed in European Patent No 1,488,167 the contents of which are hereby incorporated into the present specification for all purposes.

Figure 8:
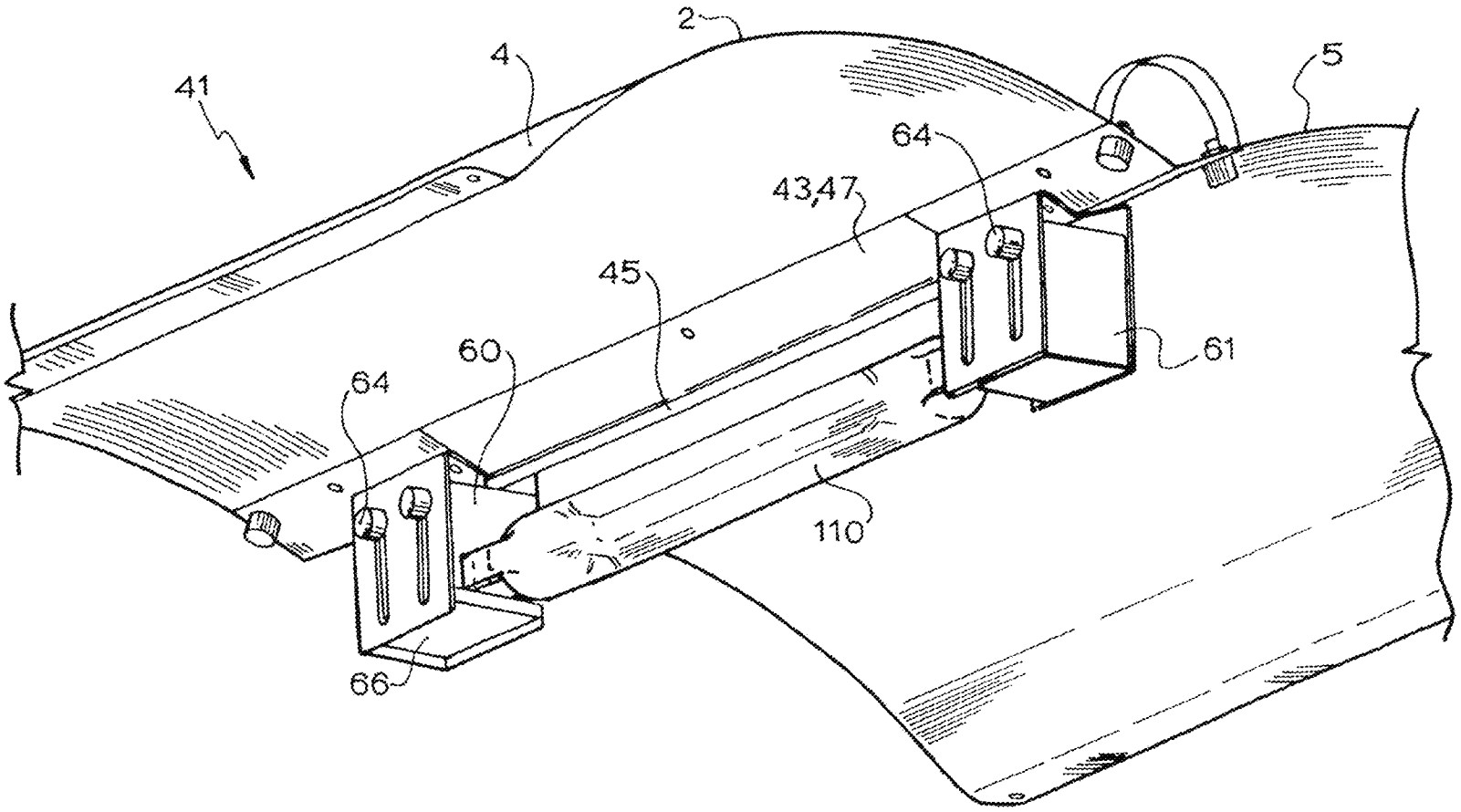
FIG. 8 is a perspective view from below of the entire luminaire of FIG. 5 with the reflector being tensioned but the tensioning filaments being omitted.
Figure 9:
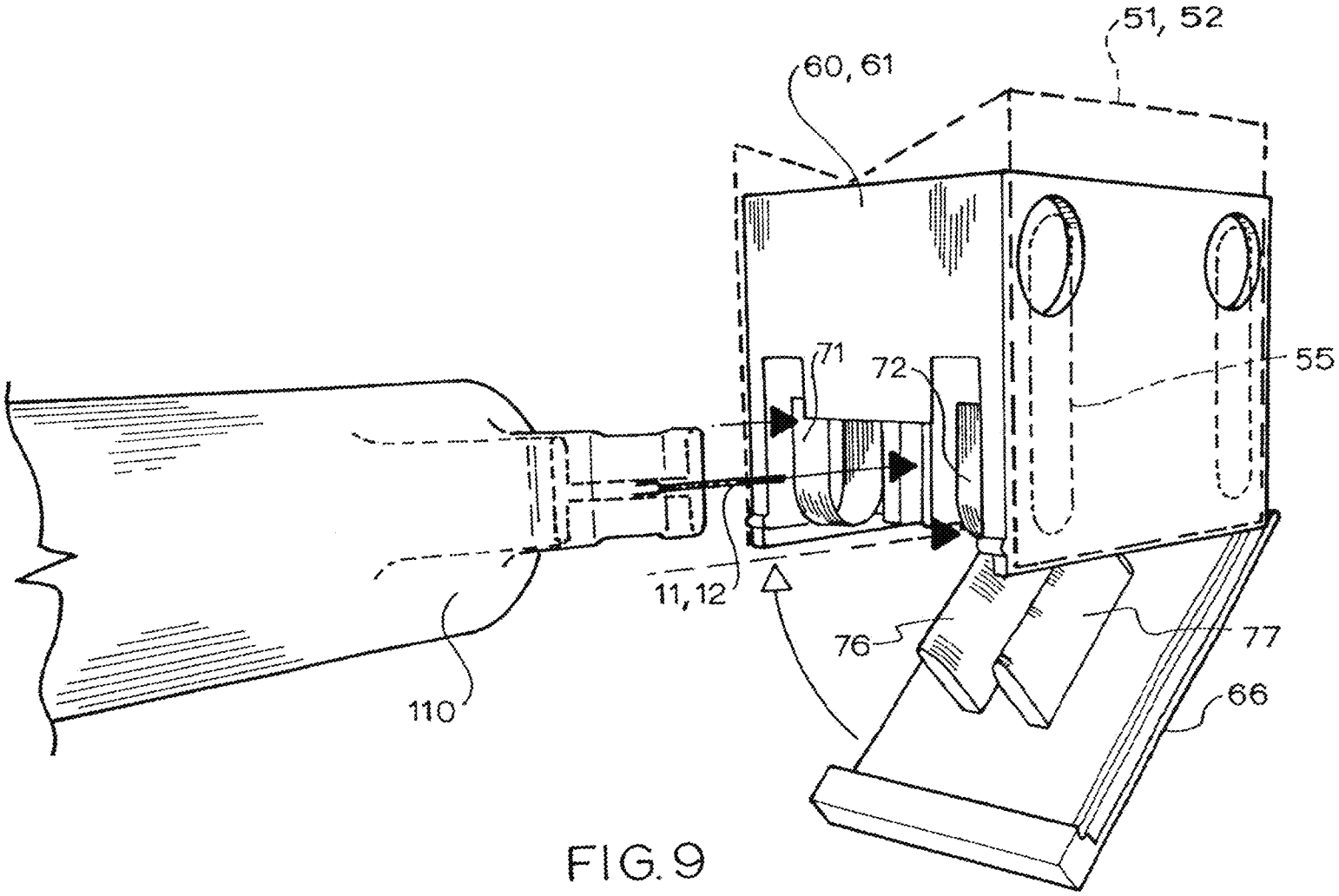
FIG. 9 is a perspective view of one of the cubic electrode clamps about to make contact.
Figure 10:
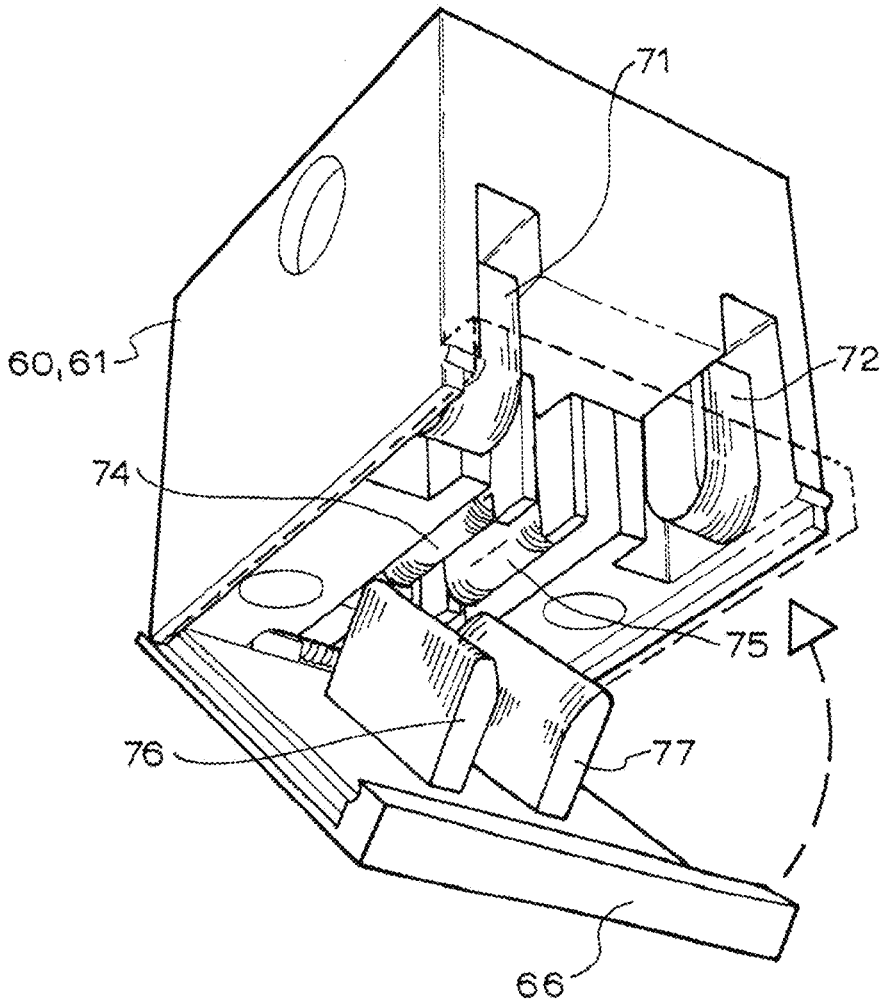
FIG. 10 is a perspective view of an open cubic electrode clamp.

As best seen in FIGS. 8 to 10, each of the electrode clamps or lamp holders 60, 61 has a pivotal lid 66 which is snap engagable into the closed position. When the lid 66 is open and raised, this enables the electrodes 11, 12 to be placed within the interior of the clamps 60, 61. The clamps 60, 61 are each provided with two U-shaped leaf springs 71, 72 and two flat V-shaped contact springs 74, 75 (FIG. 10). The leaf springs 71, 72 urge the glass end of the lamp 110 which they make contact towards the other lamp holder 60 or 61. Thus the four leaf springs acting in concert function to centre the lamp 110 between the two lamp holders 60, 61.

In addition, each end of the glass envelope of the lamp 110 is fused into a shape having a substantially H-shaped cross-section. This H-shaped end of the lamp 110 bears against the outwardly facing free ends of the U-shaped leaf springs 71, 72. As a consequence, these four springs stabilise the glass envelope of the lamp 110 by pushing against it. That is, one pair of the springs 71, 72 pushes one end of the lamp 110 in one direction aligned with the lamp axis, whilst the other pair of springs 71, 72 pushes the lamp 110 from the opposite direction. Thus these four springs tend to minimise, and push against, any miss-alignment of the lamp axis relative to the centre line extending between the lamps 60, 61.

The lamp 110 has a single metal electrode 11 or 12 at each end. The metal electrode at each end of the lamp lies between the pair of contact springs 74, 75. The contact springs have an inner face which bears against the metal electrode. The lid 66 also has two interior protrusions 76, 77 which bear against the outer faces of the contact springs 74, 75 and urge the inner faces of the contact springs 74, 75 towards each other as the lid 66 closes. Thus the inner faces contact springs 74, 75 make electrical contact with, and clamp, the corresponding one of the lamp electrodes 11, 12. In this way closing the lids 66 not only centres and secures the lamp 110, but also completes the electrical circuit between the electrodes 11, 12 and the cables 31, 32.

As seen in FIG. 5, the clamp 60 also functions as a junction box to enable the two portions of the wire or cable 32 to be connected together. In this way, only the portion of the cable 32 extending from the clamp 60 to the clamp 61 needs to be provided with the high temperature insulation.

Figure 11:
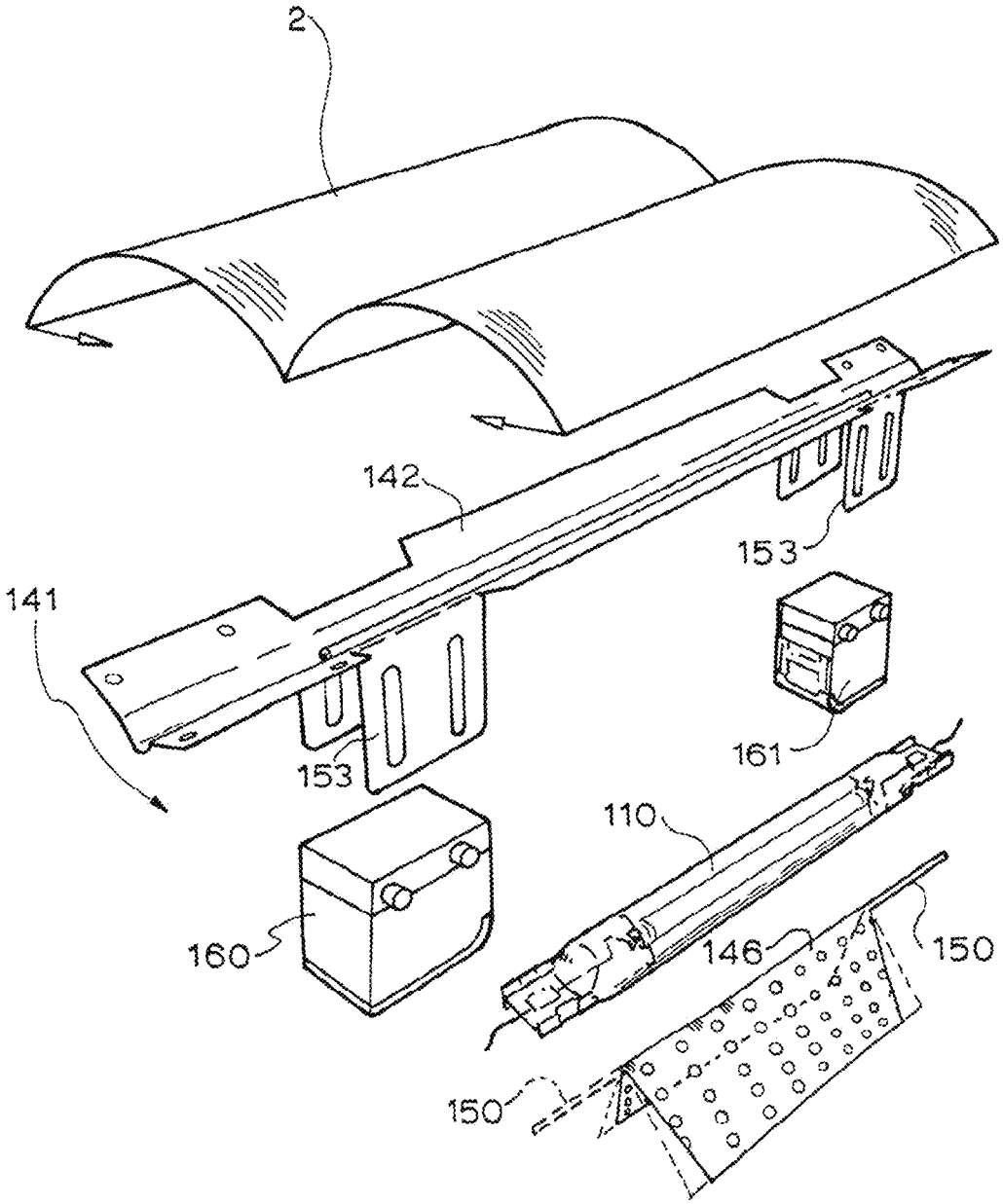
FIG. 11 is an exploded perspective view of a luminaire in accordance with another embodiment of the present invention.

Turning now to FIGS. 11-16, the luminaire 141 of another arrangement takes the form of a reflector 2, essentially as before, a ridge cap 142, a pair of electrode clamps 160, 161, a DE lamp 110 as before, and a spreader 146. The spreader 146 is essentially as disclosed in WO 1996/037732 save that as illustrated in broken lines in FIG. 9, the spreader 146 can be supported by two arms 150. In the prior art the spreader was supported by a single arm in a cantilever fashion. Also indicated by broken lines in FIG. 11, is the position of the front and rear edges of the spreader 146 if the spreader had been made from a piece of rectangular perforated metal. Instead, the front and rear edges of the spreader 146 are somewhat truncated and thus are not perpendicular to the ridge line of the spreader 146. The ridge line of the spreader 146 is also rounded or curved at its apex rather than being provided with a sharp V-shaped apex.

Figure 13:
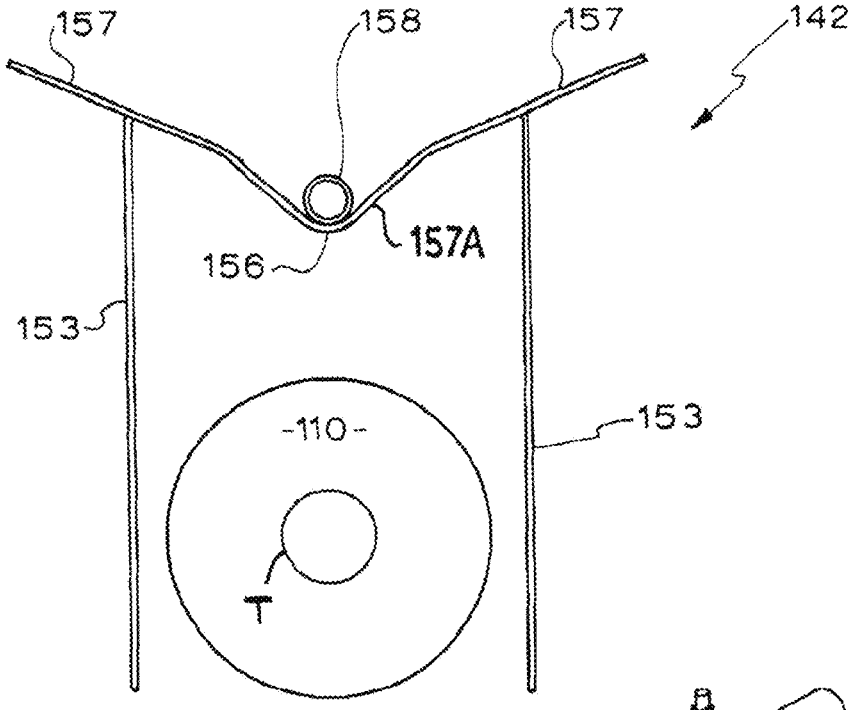
FIG. 13 is a cross-sectional view through the base of the luminaire of FIG. 12 along the line XIII-XIII with the electrode clamps omitted.
Figure 14:
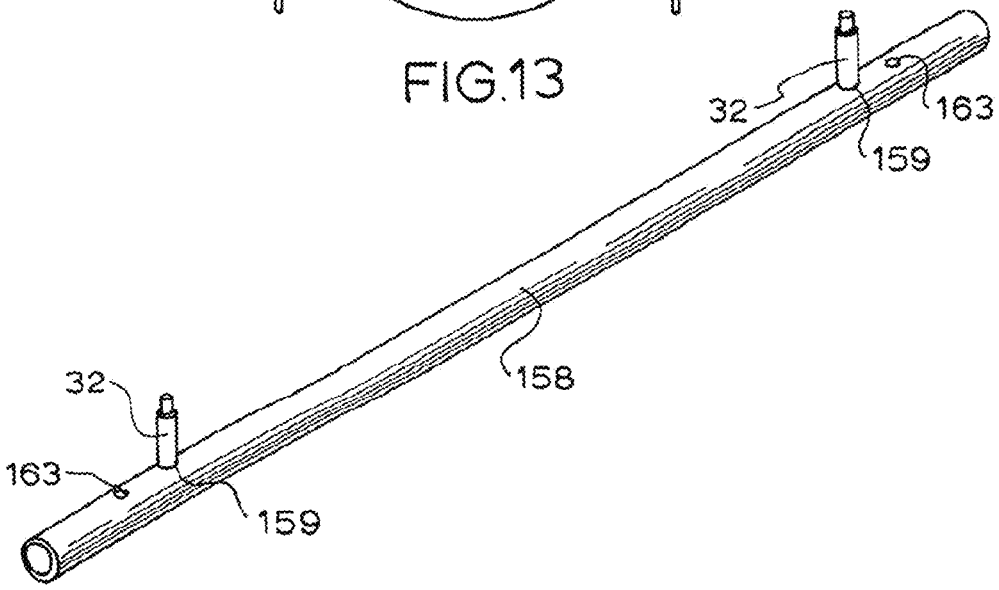
FIG. 14 is a perspective view to an enlarged scale of the conduit pipe contained within the ridge cap of the luminaire of FIGS. 11 and 12.

The ridge cap 142 is preferably stamped from reflective metallic sheet material such as that used to make the reflector 2. The ridge cap 142 is provided with four integrally formed arms 153 each of which is provided with two slots 155. As seen in FIG. 13, the ridge cap 142 is provided with a central circular arc 156, two outer flats 157 and two inner flats 157A. The angle between the outer flats 157 is preferably the same as the angle formed by the spine 3 (FIG. 1) of the reflector 2. The preferred size of this angle is approximately 120°.

Figure 12:
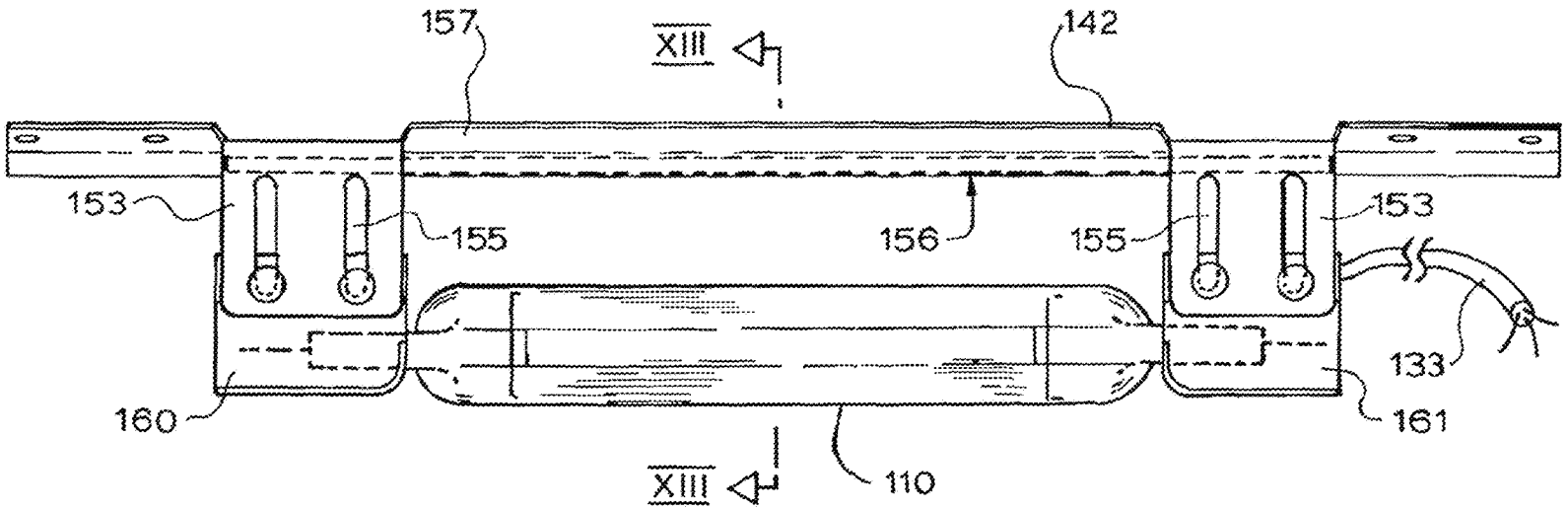
FIG. 12 is a side elevation of the luminaire of FIG. 11 with the spreader omitted.

Nestled within the arc 156 is a metal tube 158 having a pair of apertures 159 through which the cable 32 passes. The cable 32 is contained within an insulating sheath 133 (FIG. 12). The sheath 133 also contains the other power cable 31, and preferably an earth cable which is connected to the ridge cap 142. The metal tube 158 also has a pair of holes 163 (FIG. 14) which enable the metal tube to be secured to the ridge cap 142 by means of a corresponding pair of fasteners such as self-tapping screws (not illustrated). The diameter of the metal tube 158 is small enough to fit within the enclosure formed by the abutting of the outer flats 157 and the spine 3.

It will be seen from FIG. 13 that the lamp 110 is mounted very close to the ridge cap 142. The central quartz tube T-mounted within the glass envelope of the lamp 110 has a diameter of approximately 10 mm. The arc 156 preferably has a radius between 5 and 10 mm and most preferably a radius of 7 mm. This very substantially assists in creating the desirable radiation pattern discussed hereafter in connection with FIG. 17.

Figure 16:
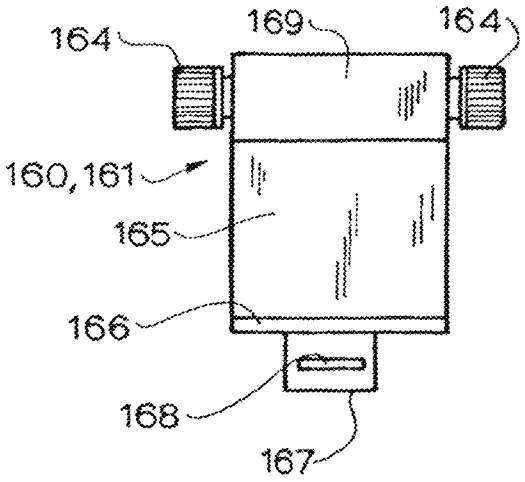
FIG. 16 is an end elevation of the electrode clamp of FIG. 15.
Figure 15:
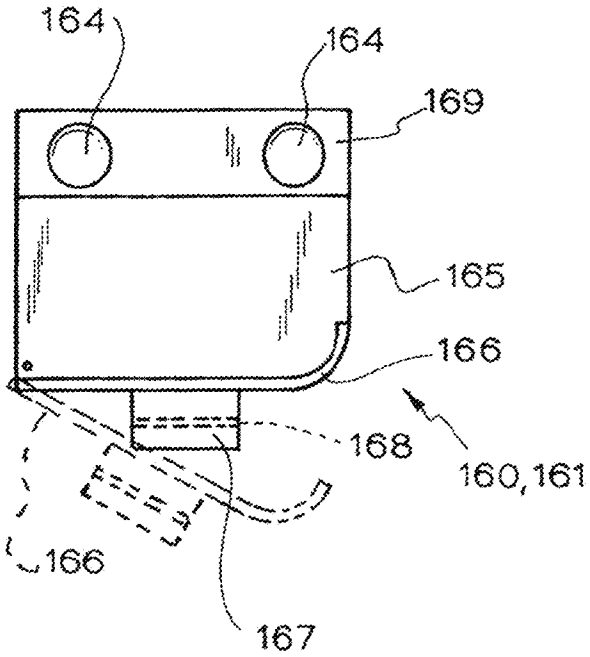
FIG. 15 is a side elevation of one of the electrode clamps of FIGS. 11 and 12.

Turning now to FIGS. 15 and 16, the electrode clamps 160, 161 are essentially fabricated to be mounted on a flat surface. Accordingly, the electrode clamps 160, 161 are each provided with a body 165 and a lid 166. The lid 166 has a protruding mounting boss 167. The mounting boss 167 has a central opening 168 which is dimensioned to receive one of the spreader arms 150 in a frictional fit. In this way, the spreader 146 is supported by the electrode clamps 160, 161.

In addition, the body 165 is secured to a corresponding mounting base 169. Preferably this is done by means of screw fasteners (not illustrated but conventional). The interior of the mounting base 169 functions as a junction box. Each of the two mounting bases 169 carries four screws 164, the shanks of which are sized to pass through the slots 155 of the ridge cap 142. In this way, the bases 169 enable the vertical position of the lamp 110 below the ridge cap 142 to be adjusted. Once the desired position of the electrode clamps 160, 161 is achieved, the position of the clamps is secured by finger tightening the knurled heads of the screws 164. A vertical adjustment of the position of the lamp 110 in the vicinity of 40 mm is preferably able to be achieved. The base 169 converts an electrode clamp 60, 61 intended to be mounted to a flat surface to an electrode clamp able to be mounted between a pair of vertical surfaces.

It will be understood from FIGS. 12 and 13 in particular, that there are a number of possible ways in which the lamp 110 can be out of parallel with the spine 3. The most obvious way is that one end of the lamp 110 is closer to the spine 3 than the other end of the lamp 110 but that the lamp 110 and the spine 3 lie in the same vertical plane. That is to say, the lamp 110 is slightly tilted in a vertical plane.

Alternatively, or in addition, the lamp 110 can be tilted in a substantially horizontal plane which is parallel to the spine 3. That is, one end of the lamp 110 lies to the left of the spine 3 whereas the other end of the lamp 110 lies to the right of the spine 3. This defect can also be rectified by a judicious bending of the arms 53, 153 so as to slightly realign the lamp holders. In this way, each of the lamp holders is independently able to be manipulated so as to ensure that the lamp 110 lies parallel to the spine 3 both within a vertical plane passing through the spine 3, and a horizontal plane which is parallel to the spine 3. This ability to independently manipulate the lamp holders ensures that the desired arrangement of the lamp 110 being parallel to the spine 3 is achieved, which thereby results in an even and symmetrical distribution of light by the reflector 2. If the lamp 110 is skewed relative to the spine 3, so the distribution of light will be unsymmetrical.

Once the luminaire 41,141 is mounted in a greenhouse, for example, it is not subject to being bumped or moved and thus this fine initial adjustment, once made, need never be altered.

Figure 17:
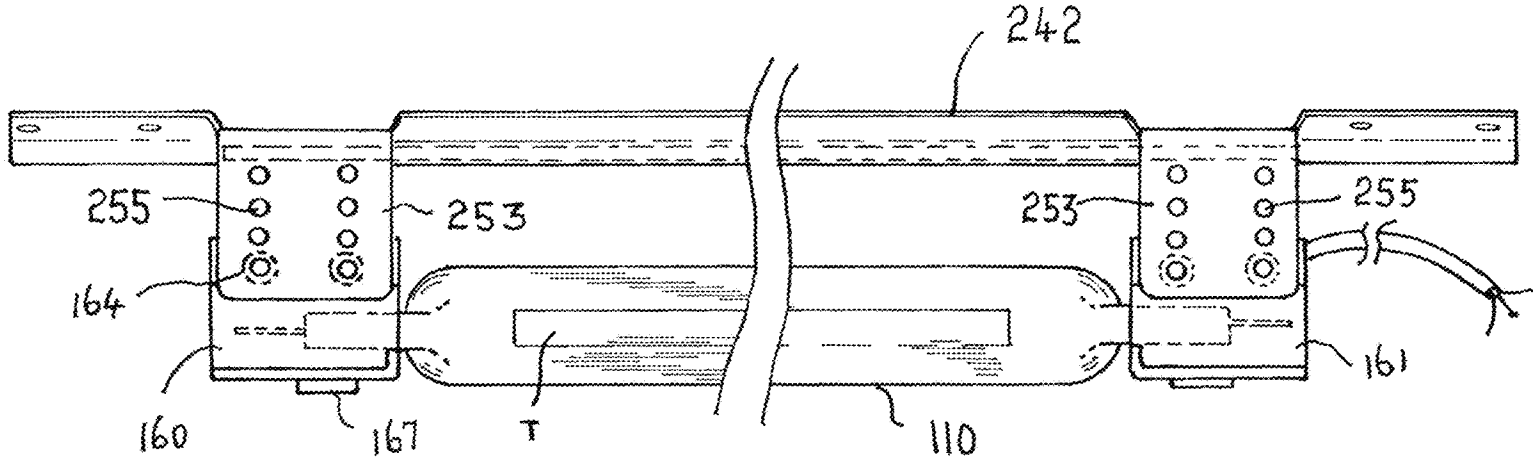
FIG. 17 is a side elevation of another arrangement with an alternative ridge cap.
Figure 18:
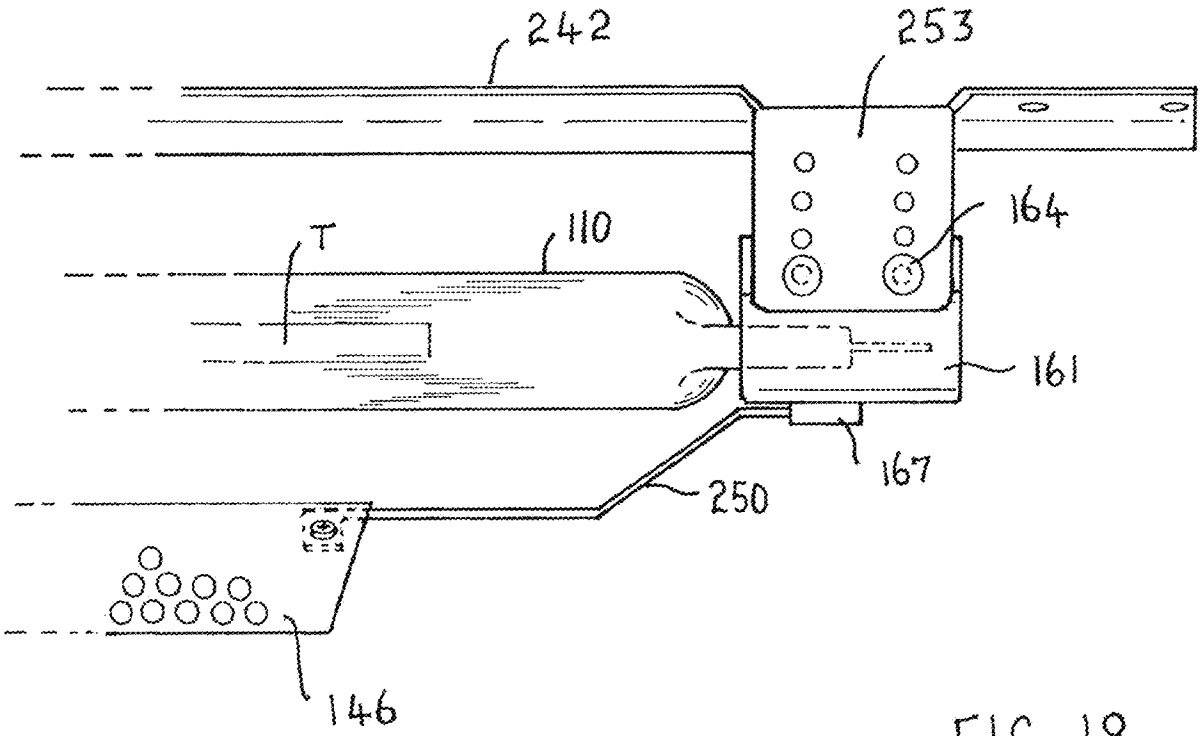
FIG. 18 is a partial side elevation of the arrangement of FIG. 17 and showing a cranked spreader support.

Turning now to FIGS. 17 and 18, a revised form of ridge cap 242 is illustrated in which the arms 253 instead of having slots 155 as described above, instead have a series of aligned spaced apart apertures 255 which are sized to receive the shanks of the screws 164. The apertures 255 enable any one of four different vertical spacings between the ridge cap 242 and the lamp 110 to be achieved. The advantage of the apertures 255 over the slots 155 is that a parallel positioning of the longitudinal axis of the lamp 110 relative to the ridge cap 242 is guaranteed.

Furthermore, as seen in FIG. 18, a single cranked spreader arm 250 is provided to support the spreader 146. The preferred arrangement for the spreader 146 is that the length of the spreader 146 should approximately correspond to the length of the central quartz tube T of the lamp 110 and that the ends of the spreader 146 should be approximately aligned with the corresponding ends of the central quartz tube T.

Figure 19:
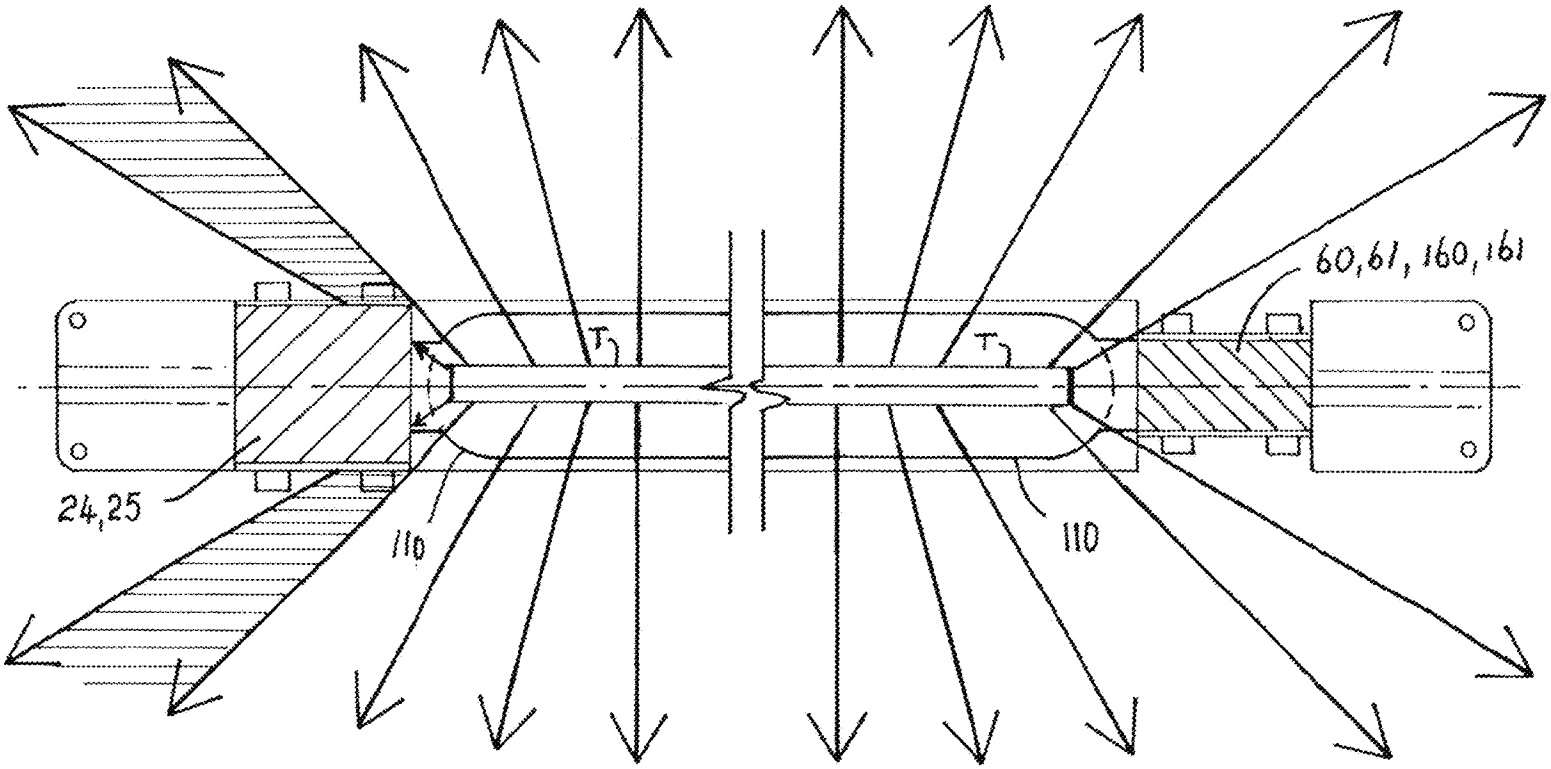
FIG. 19 is an inverted plan view showing a comparison between the shadows cast utilising the electrode clamps 24, 25 and the electrode clamps 60, 61, 160, 161.

Turning now to FIG. 19, a schematic inverted plan view contrasting the arrangements of FIG. 3 on the one hand and FIGS. 5, 11 and 17 on the other hand illustrates the difference in the light distribution. With the electrode clamps 24, 25 of FIG. 3, the width of the clamp exceeds the width of the shadow cast by the opaque end of the central quartz tube T. As a consequence, as indicated by horizontal shading lines in FIG. 19, the electrode clamp 24, 25 casts a shadow at the end of the luminaire. However, where the slim electrode clamps 60, 61, 160, 161 are utilised, then the shadow cast by the opaque end of the central quartz tube T exceeds or approximately equals the width of the electorate clamp. As a consequence, only the absolutely minimum unavoidable shadow created by the tube T itself is present in the luminaire.

Figure 20:
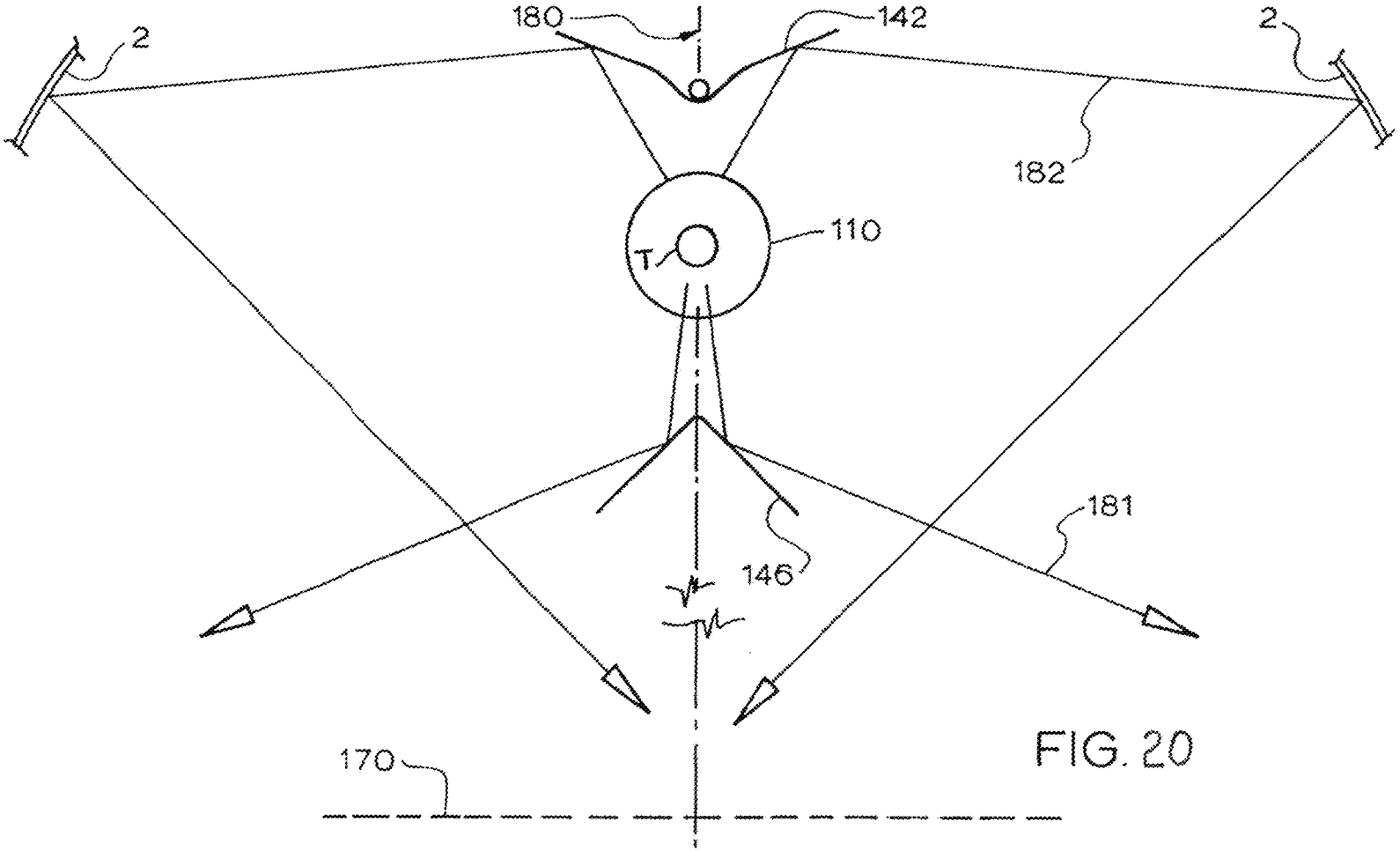
FIG. 20 is a schematic and truncated vertical cross-sectional view through the luminaire of FIGS. 11 and 12 showing the pattern of light rays produced by the luminaire.

In FIG. 20 the arrangement of the ridge cap 142, reflector 2, lamp 110, spreader 146 and the upper level 170 of vegetation growing within a greenhouse, for example, is schematically illustrated. The light and heat energy emitted by the lamp 110 is very intense. The light energy which is emitted downwardly would burn the vegetation were it not for the spreader 146 which deflects rays such as rays 181 to the left and right of the centreline 180. Because of the small apertures in the spreader 146, some of the downwardly emitted light and heat energy passes through the spreader 146 but the reduced intensity of this downwardly emitted energy is insufficient to burn the vegetation.

In addition, upwardly directed light energy from the lamp 110 strikes the circular arc 156 and the two flats 157 and 157A, and is directed outwardly towards the reflector 2. As a consequence, rays such as rays 182 are re-directed by the reflector 2 downwardly and centrally. The net result is a substantially uniform level of illumination at the vertical height 170. There will in general be some miss-alignment between the longitudinal axis of the lamp 110 and the longitudinal axis of the ridge 142 and spine 3. The circular arc 156 is instrumental in splashing or smearing the light emitted directly onto the circular arc 156 and this results in a more even spread of light than would be the case if a sharp V-shaped ridge was used instead of the circular arc 156.

Whilst it is possible to operate a single luminaire 41, 141 as a single light source, most horticultural applications require multiple luminaires. In particular these are mounted in a rectangular array or grid so as to create as uniform a light intensity as possible over a relatively large area. In general, there are 2 levels of illumination, a lower level such as is required for cut flower production where the period of natural light, for example, is extended so as to time the production of the flowers, and a higher level such as is required for seedling propagation and general garden production, of vegetables for example. The different levels of illumination are achieved by different height settings of the luminaires relative to the level of the plants.

Figure 21:
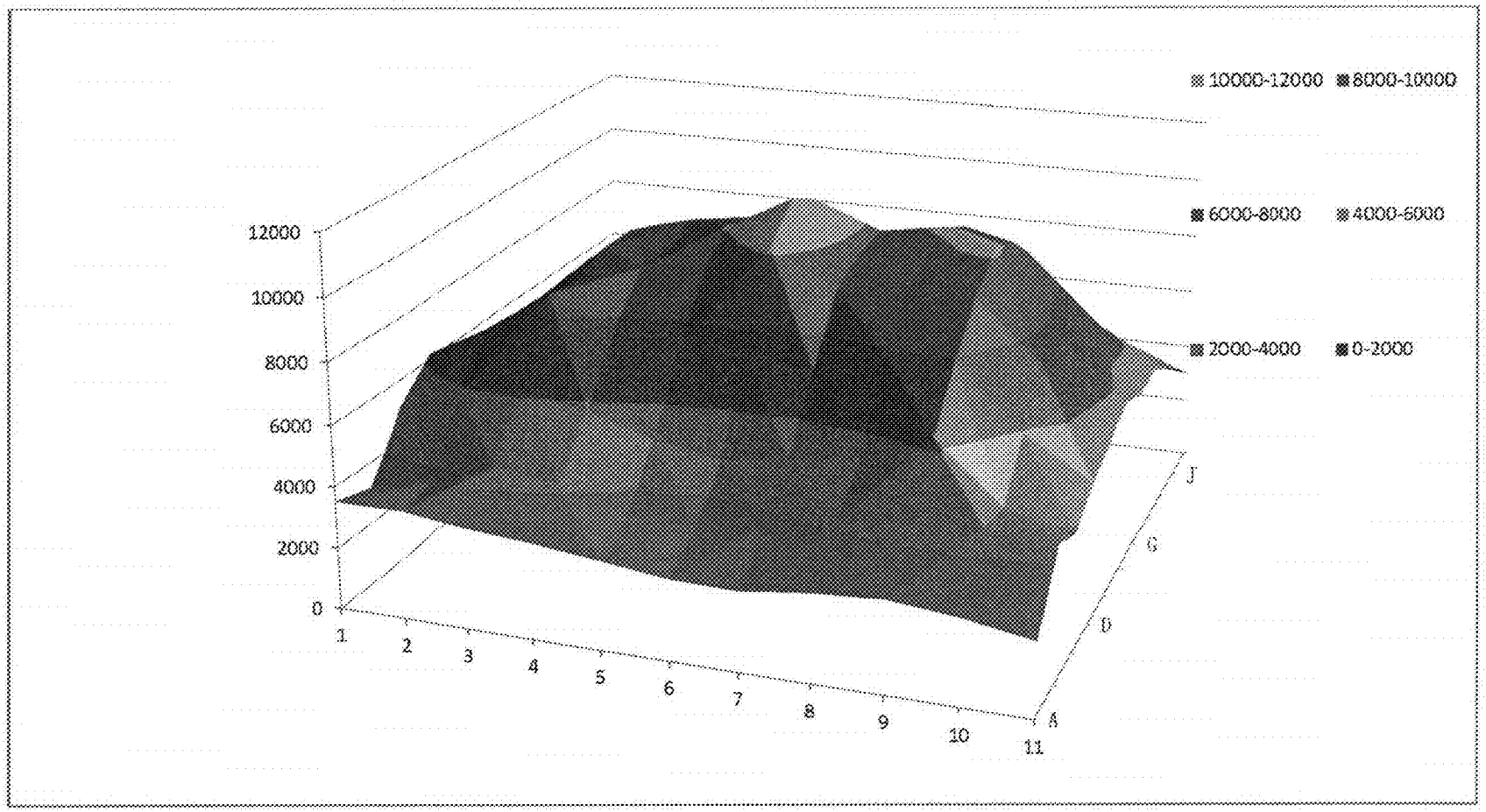
FIG. 21 PRIOR ART
FIG. 21 is a test result for a prior art luminaire and lamp arrangement without spreader and with the lamp 5 feet above the base.
Figure 22:
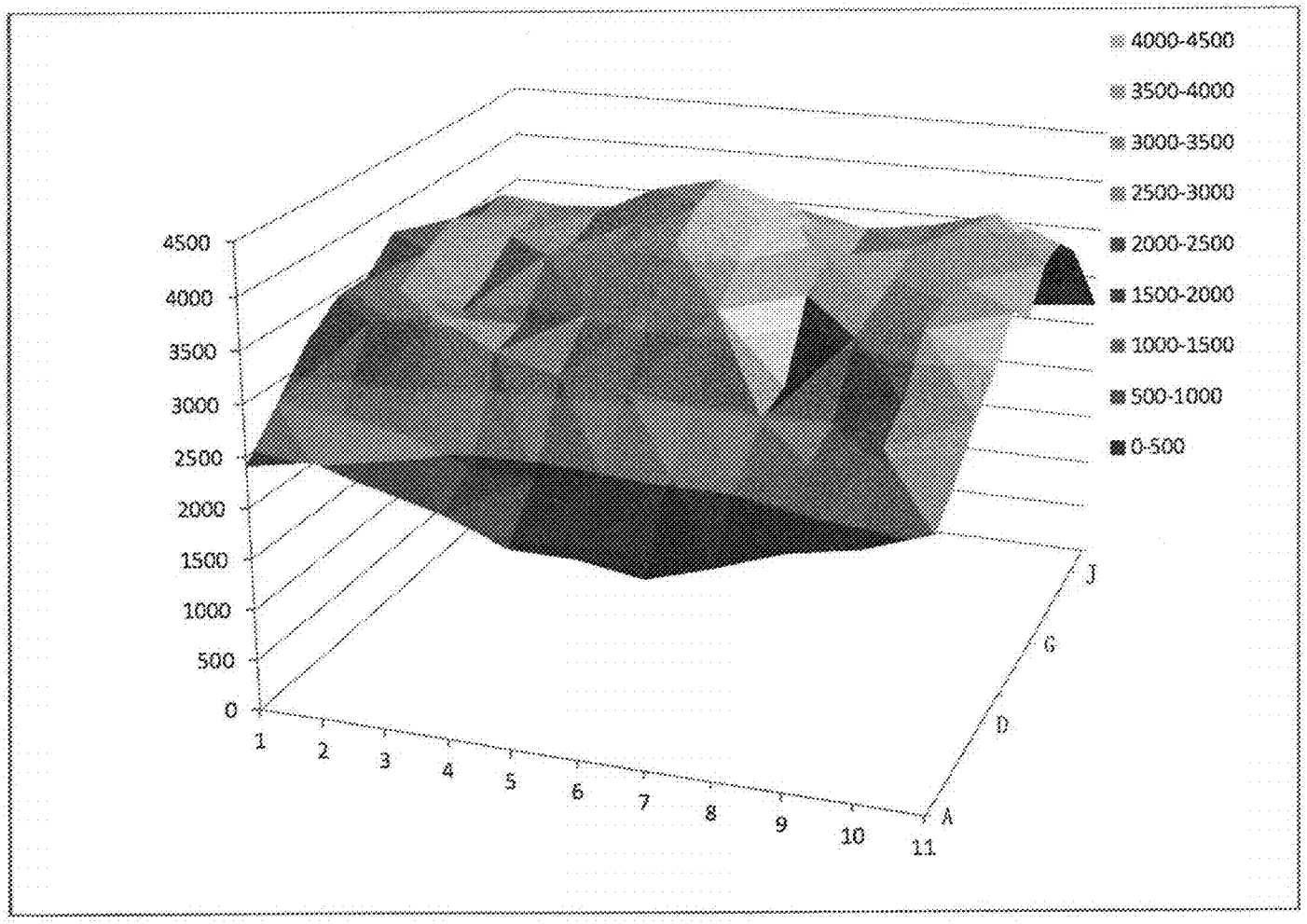
FIG. 22 PRIOR ART
FIG. 22 is a further test result for the same prior art luminaire but with the lamp 8 feet above the base.

Set out in FIGS. 21 and 22 are test results of an 11'×10' test bed area illustrating the light produced by a GAVITA (™) PRO DE US luminaire with a combined ballast and reflector in which a 1000 W GAVITA DE lamp was mounted. For the results of FIG. 21, the lamp was mounted 5 feet above the test bed surface whereas for FIG. 22 the lamp was mounted 8 feet above the test bed surface. In each instance no spreader was used.

It will be seen that in each case there is a hot spot below the lamp and the illumination intensity is not uniform. The illumination intensity is given in lumens and the higher figure of approximately 10,000 lm corresponds to a light intensity as required for seedling propagation, for example, whereas the lower level of approximately 3500 lm corresponds to the level of intensity required for cut flower production.

Figure 23:
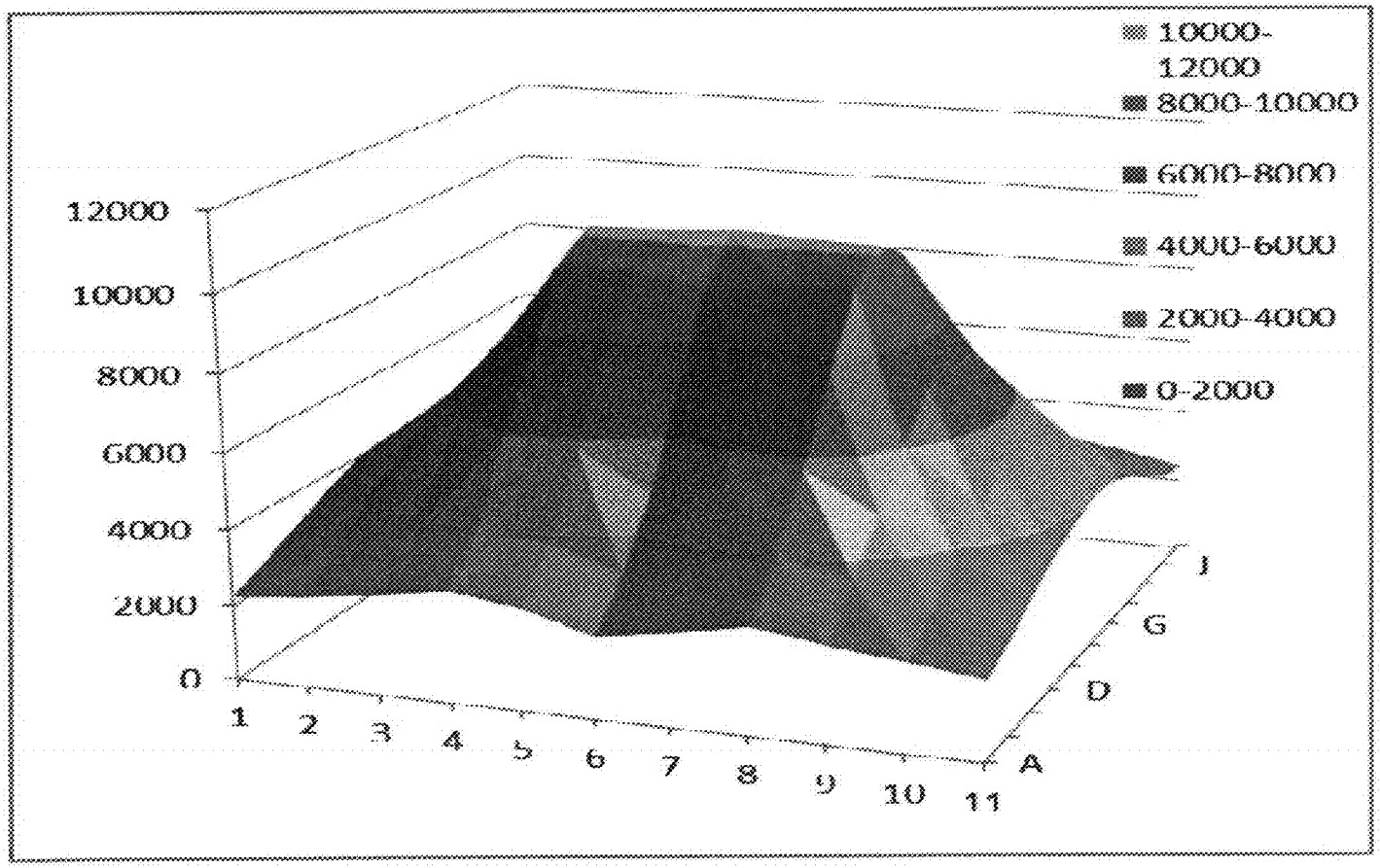
FIG. 23 is a test result equivalent to FIG. 18 but for the luminaire 141 with spreader and with the lamp 5 feet above the base.
Figure 24:
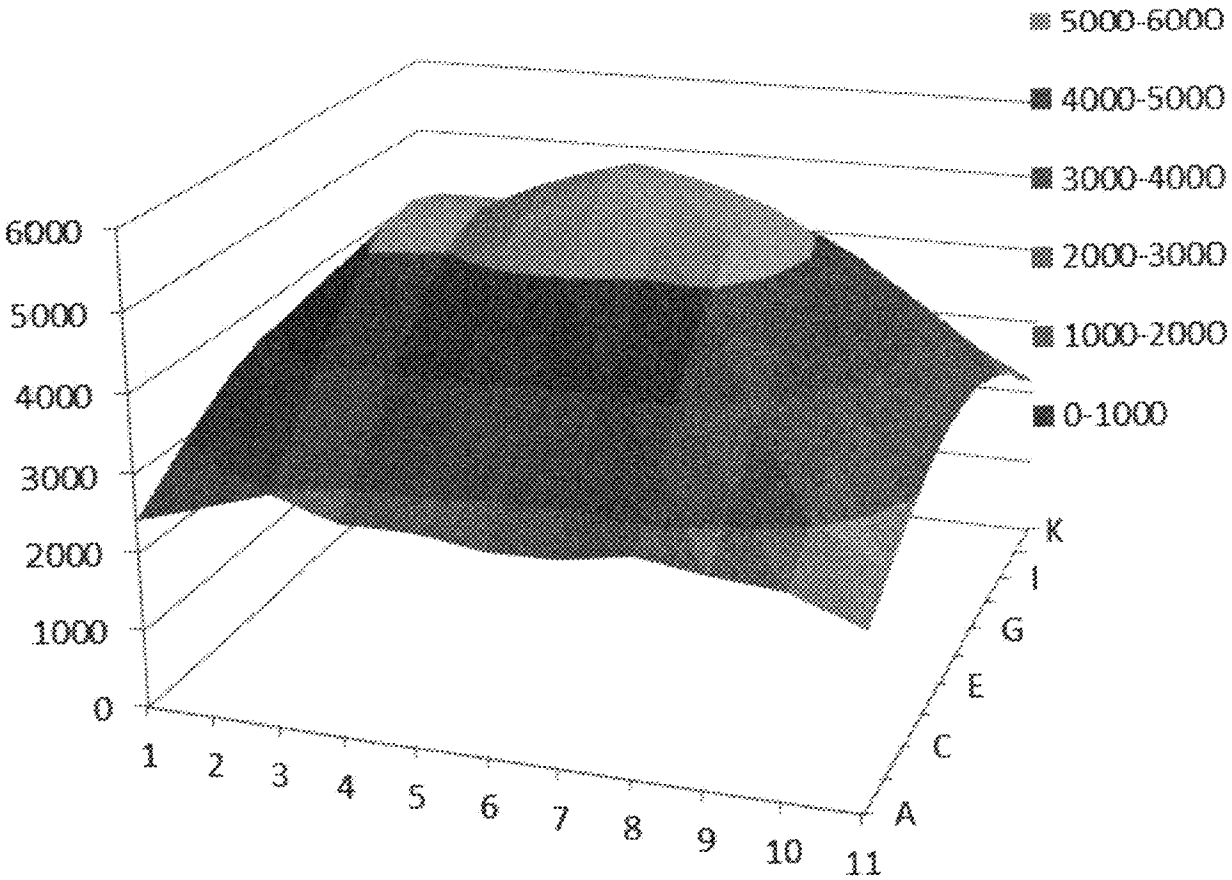
FIG. 24 is a further test result for the luminaire 141 with spreader and with the lamp 8 feet above the base.

This is to be contrasted with the same test bed conditions for the same lamp but mounted in the luminaire 141 of FIG. 11 including the spreader 146. The results are illustrated in FIGS. 23 and 24. It will be seen that in each instance the radiation distribution is much more regular and even and with comparable illumination intensities. In all tests, a warm up period of approximately 40 minutes was utilised.

In addition, it has been experimentally determined that the prior art luminaire used in the test results of FIGS. 21 and 22 cannot be lowered so as to be closer than approximately 4 feet (1.2 meters) from plants without the plants being burnt by the intensity of the emitted radiation. However, the luminaire used in the test results of FIGS. 23 and 24 has been lowered to within approximately 3 feet (1 meter) from plants without burning the plants. It is thought that at this height the amount of illumination received by the plants exceeds the photosynthesis ability of the plants.

Figure 25:
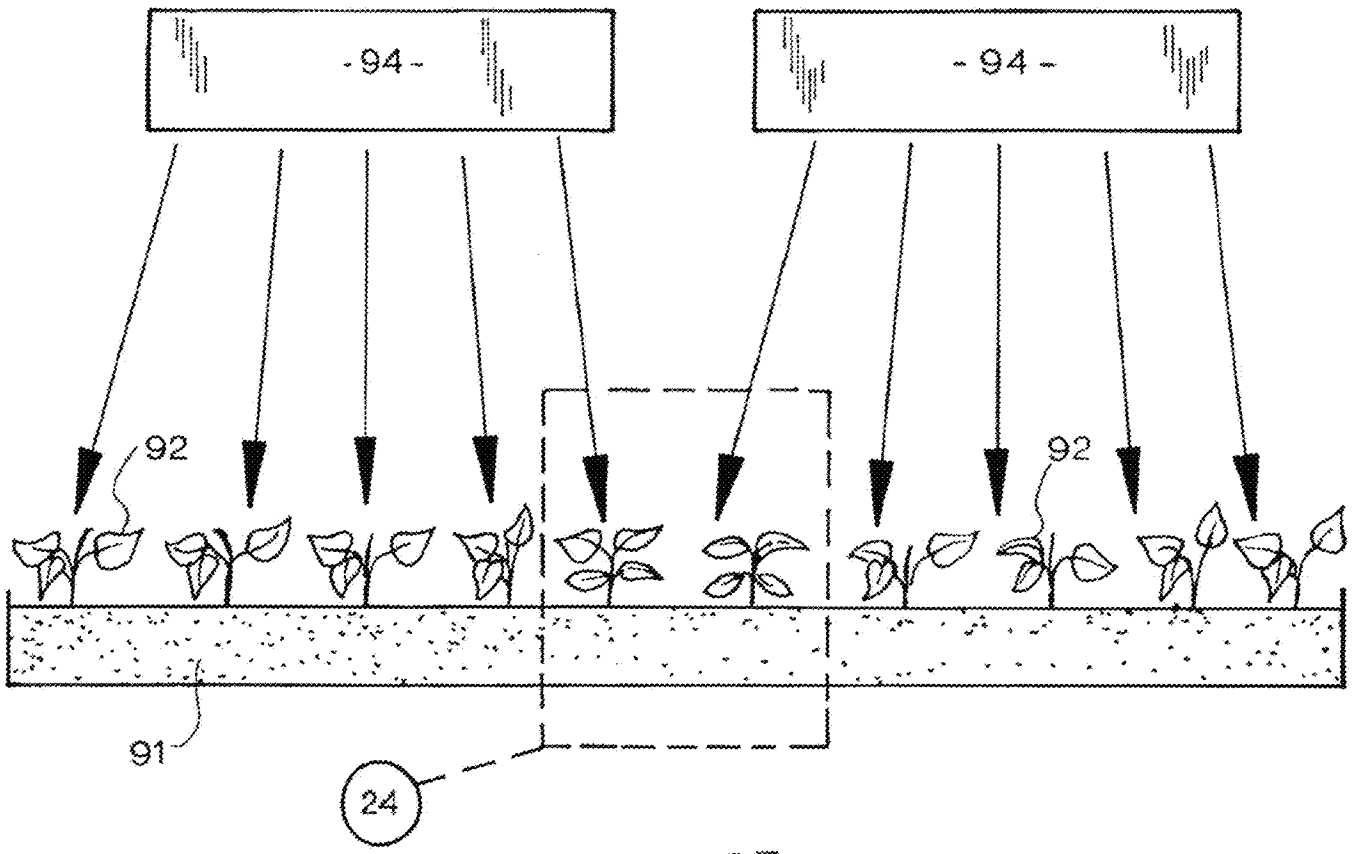
FIG. 25 PRIOR ART
FIG. 25 is a schematic cross-sectional view of a prior art greenhouse arrangement.
Figure 26:
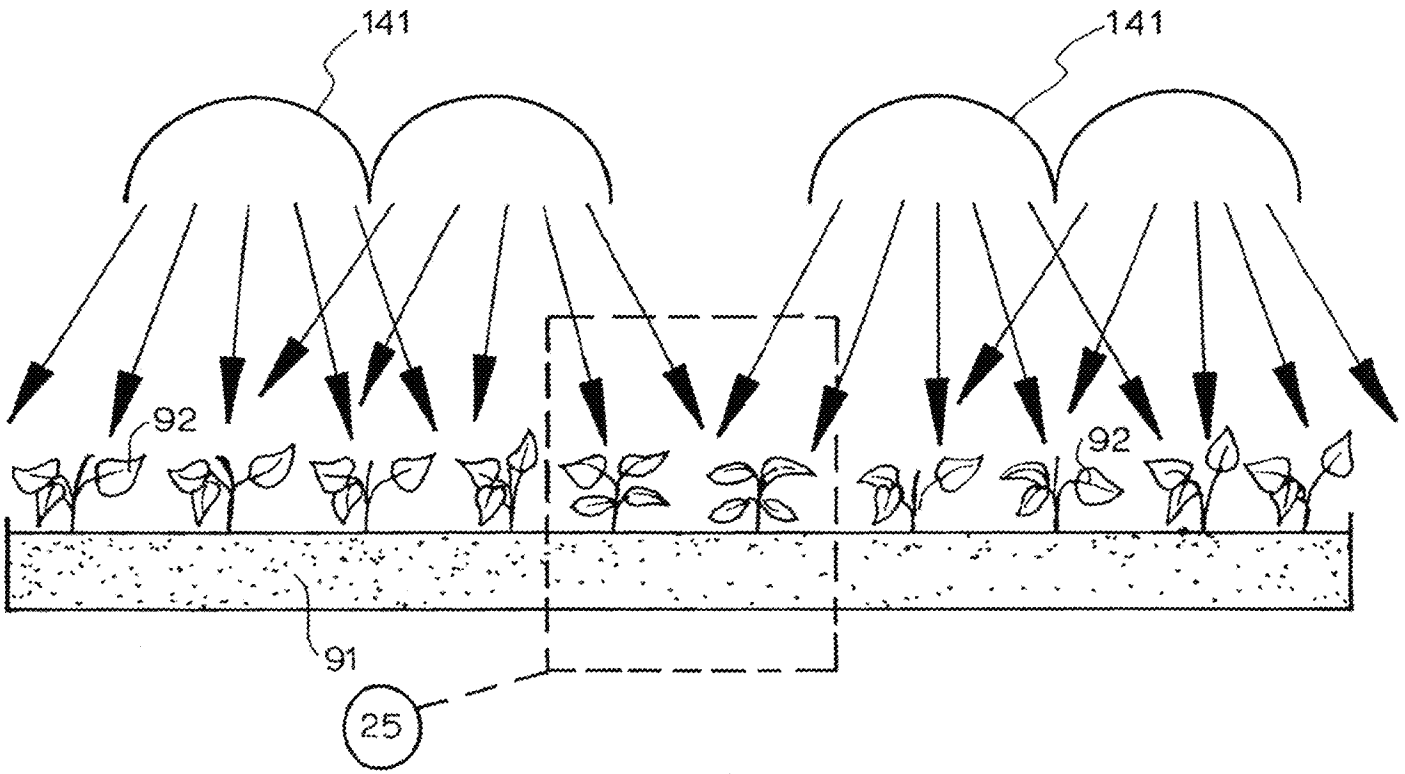
FIG. 26 is an equivalent view to that of FIG. 25 but utilizing the luminaire of FIGS. 11 and 12.

Turning now to FIGS. 25-28, in FIGS. 25 and 26 two comparable greenhouse installations are illustrated in schematic fashion. Each greenhouse has trays 91 of plants 92 which are respectively illuminated with light from two conventional luminaires 94 in FIG. 25 and two luminaires 141 in accordance with the embodiment of FIGS. 11 and 12 in FIG. 26.

In accordance with the measured results of FIGS. 23 and 24 it will be seen that the light from the conventional luminaires 94, although it spreads out in FIG. 25 to the left and right of the lamp longitudinal axis, does not spread as far as does the light from the luminaires 141 of FIG. 26. This is particularly important in the regions of the greenhouse in between a pair of adjacent luminaires.

Figure 28:
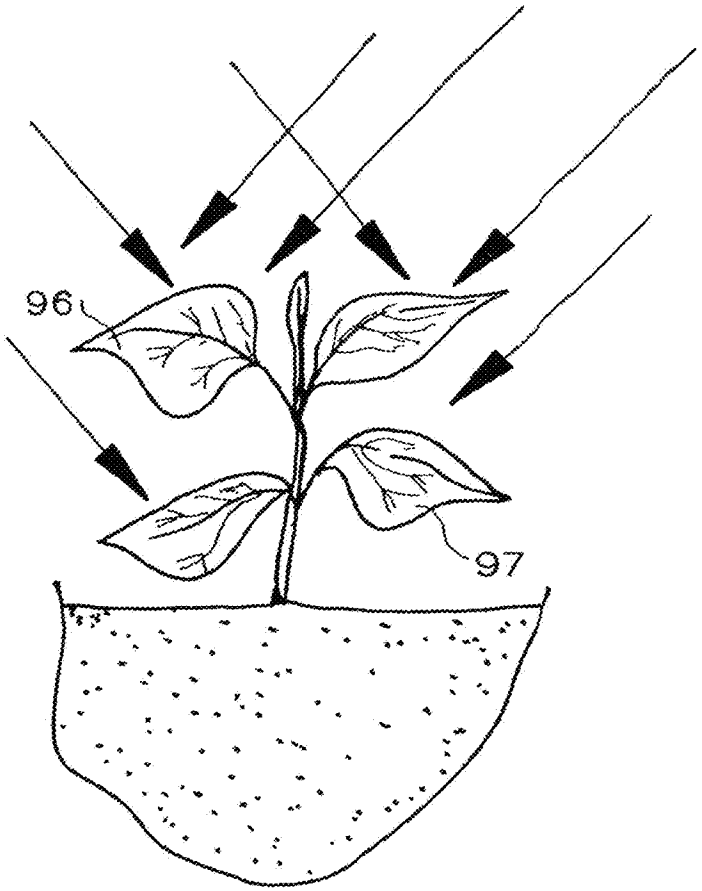
FIG. 28 is a view to a larger scale of a portion of FIG. 26 showing the incident light.
Figure 27:
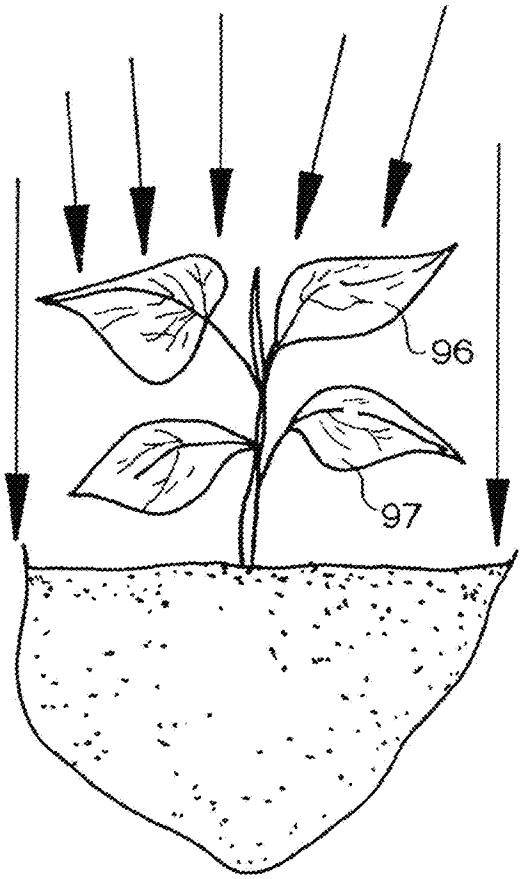
FIG. 27 PRIOR ART
FIG. 27 is a view to a larger scale of a portion of FIG. 25 showing the prior art incident light.

The situation in between adjacent luminaires is illustrated in more detail in FIGS. 27 and 28. It will be appreciated in this connection that the leaves 96, 97 of most plants, whilst not horizontal, will have a substantial horizontal component to their direction of growth. That is, leaves tend to grow sideways more than they grow vertically. As a consequence, the upper leaves 96 tend to naturally shade the lower leaves 97. Since in a natural setting, the incident angle of sunlight falling on leaves changes with the time of day between sunrise and sunset, this shading will vary with time and thus is not of much consequence.

However, in a greenhouse situation the source of light is stationary. So as illustrated in FIG. 27 where the rays of light have little lateral spread, the upper leaves 96 tend to shade the lower leaves 97. However, in the situation illustrated in FIG. 28, the rays of light have a substantial lateral spread and therefore the lower leaves 97 receive more direct light. This is of substantial benefit to plants generally, less so for seedlings, but particularly so for more mature plants.

The foregoing describes some embodiments of the present invention and modifications, obvious to those skilled in the art, can be made thereto without departing from the scope of the present invention. For example, the metal sheet from which the reflector 2 is fabricated can be coated with white paint, or can be anodised aluminum, or can be coated by a "glass" formed by PVD (poly vapour deposition).

The term "comprising" (and its grammatical variations) as used herein is used in the inclusive sense of "including" or "having" and not in the exclusive sense of "consisting only of".

The invention claimed is:

1. A luminaire for a double ended tubular HID lamp, said luminaire comprising:

a reflector of generally rectangular configuration when viewed in plan, formed from sheet metal, having a V-shaped configuration when viewed in end elevation and in a relaxed state, and being bendable into a tensioned state having a generally M-shaped configuration when viewed in end elevation, a central region of said V and M shape constituting a spine;

a pair of lamp holders connected to said spine and spaced apart a distance corresponding to the length of said tubular lamp; and a hollow conduit extending between said lamp holders;

wherein said hollow conduit has a pair of arms corresponding to each said lamp holder and arranged to receive said lamp holder, and at least one fastener passes through each said arm and into said lamp holder whereby said fasteners determine the spacing of said lamp holders relative to said spine.

2. The luminaire as claimed in claim 1 wherein each said lamp holder is configured to mount on a flat surface, each said lamp holder is mounted on a corresponding base, and said fasteners pass into said base, whereby each said lamp holder is converted to mount between said pair of arms.

3. The luminaire as claimed in claim 2 wherein each said arm has an elongate slot corresponding to each said fastener and through which said fastener passes.

4. The luminaire as claimed in claim 2 wherein each said arm has a plurality of spaced apart apertures corresponding to each said fastener and through one of which said fastener passes.

5. A luminaire for a double ended tubular HID lamp, said luminaire comprising:

a reflector of generally rectangular configuration when viewed in plan, formed from sheet metal, having a V-shaped configuration when viewed in end elevation and in a relaxed state, and being bendable into a tensioned state having a generally M-shaped configuration when viewed in end elevation, a central region of said V and M shape constituting a spine;

a pair of lamp holders connected to said spine and spaced apart a distance corresponding to the length of said tubular lamp;

a hollow conduit extending between said lamp holders, said hollow conduit comprising a V-shaped member adjacent said spine; and a pair of insulated electric cables extending away from a first one of said lamp holders, a first one of said cables being connected to said first lamp holder and a second one of said cables extending through said hollow conduit to said second lamp holder.

6. The luminaire as claimed in claim 5 wherein said V-shaped member comprises a pair of flats located one to either side of a central region in the form of a substantially part cylindrical sheet.

7. The luminaire as claimed in claim 6 wherein a tube is located within said part cylindrical central region.

8. The luminaire as claimed in claim 7 wherein said tube has a pair of spaced apart apertures providing access and egress for said second cable.

9. The luminaire as claimed in claim 5 wherein said V-shaped member comprises an inner V-shaped ridge cap having a gutter which protrudes through a slot in an outer V-shaped ridge cap.

10. The luminaire as claimed in claim 9 wherein said inner ridge cap has a shorter length than said outer ridge cap.

11. The luminaire as claimed in claim 10 wherein said inner ridge cap is substantially the same length as said slot and said outer ridge cap is substantially the same length as said reflector.

12. The luminaire as claimed in claim 5 and including a pair of spaced apart electrode clamps aligned with said spine.

13. The luminaire as claimed in claim 12 wherein each of said electrode clamps has a corresponding pivoted lid which actuates the corresponding clamp.

14. The luminaire as claimed in claim 12 wherein said electrode clamps are mounted to be movable toward, or away from, said reflector.

15. The luminaire as claimed in claim 14 wherein said electrode clamps are designed to mount on a flat surface, each said clamp is mounted on a base, said base includes at least two securing screws arranged in corresponding slots in a pair of arms which extend away from said reflector, whereby each said electrode clamp is movable toward or away from said reflector by loosening said screws and sliding same along the corresponding slots.

16. The luminaire as claimed in claim 15 wherein said arms and said V-shaped member are stamped from a single sheet of reflective material.

17. A luminaire for a double ended lamp having an electrical contact at each end thereof, said luminaire comprising a reflector having a centre-line, a cable conduit extending along said centre-line between a pair of lamp holders and including an electrical cable therein, and each of said lamp holders being independently manipulatable to enable a lamp to be mounted between said holders and substantially parallel to said centre-line.

* * * * *